US005337499A

United States Patent [19]

Isozaki

[11] Patent Number: 5,337,499

[45] Date of Patent: Aug. 16, 1994

[54] DRIER APPARATUS FOR DRYING SHEETS OF PHOTOSENSITIVE MATERIAL

[75] Inventor: Masakazu Isozaki, Kanagawa, Japan

[73] Assignee: Fuji Photo Film Co., Ltd., Kanagawa, Japan

[21] Appl. No.: 984,487

[22] Filed: Dec. 2, 1992

[30] Foreign Application Priority Data

Dec. 2, 1991 [JP] Japan ..... 3-318083
Apr. 20, 1992 [JP] Japan ..... 4-099883

[51] Int. Cl.[5] ..... F26B 19/00

[52] U.S. Cl. ..... 34/549; 34/114; 34/620

[58] Field of Search ..... 34/48, 41, 39, 46, 114, 34/151

[56] References Cited

U.S. PATENT DOCUMENTS 3,211,893 10/1965 Barlow et al. ..... 34/48 X

OTHER PUBLICATIONS

Published English-Language Abstract of Japanese Patent Application Laid-Open No. 2-149845, "Drying Method", Toshio Kurokawa Jun. 8, 1990.

Published English-Language Abstract of Japanese Patent Application Laid-Open No. 3-132659, "Photosensitive Material Dryer" Toshio Kurokawa Jun. 6, 1991.

*Primary Examiner*—Henry A. Bennet

*Attorney, Agent, or Firm*—Sughrue, Mion, Zinn, Macpeak & Seas

[57] ABSTRACT

A drier apparatus for drying sheets of photosensitive material processed with processing solutions while the photosensitive material is being transported. Rollers are provided along a transport passage for transporting the photosensitive material, and the rollers transport the photosensitive material and dry the photosensitive material by heating. The rollers are heated by heaters, respectively. The surface temperature of each roller is detected by a temperature detector, and a controller controls the heaters in such a manner that the range of fluctuation of the surface temperature of each roller falls within a predetermined range of values on the basis of the change with time of the detected surface temperatures of the rollers.

20 Claims, 17 Drawing Sheets

$T_C$: CONTROL PERIOD $T_S$: SAMPLING PERIOD

DRIER APPARATUS FOR DRYING SHEETS OF PHOTOSENSITIVE MATERIAL

BACKGROUND OF THE INVENTION

1. Field of the Invention

The present invention relates to drier apparatus for drying sheets of photosensitive material, and more particularly to a drier for drying a photosensitive material processed with processing solutions while the photosensitive material is being transported.

2. Description of the Related Art

Hitherto, drier apparatus has been proposed in which a photosensitive material is wound around a heat roller heated by a heater and the photosensitive material is dried by heating. The adjustment of the surface temperature of this heat roller has been carried out by the so-called on-off control. This on-off control is effected by detecting the surface temperature of the heat roller by means of a temperature sensor disposed in the vicinity of the surface of the heat roller, and by turning on and off the heater in correspondence with the temperature difference with respect to a set temperature such that the surface temperature of the heat roller becomes the set temperature. With this method, however, there have been drawbacks in that the loss of heat through contact with the photosensitive material causes a decline in the surface temperature of the heat roller, and that the surface temperature, after declining, can rise excessively high, so that the surface temperature of the heat roller fluctuates substantially and the deviation from the targeted temperature becomes large, thereby making it difficult to dry a plurality of photosensitive materials on a stable basis.

with the conventional on-off control, there have been cases where the finished quality of the photosensitive material after being dried varies depending on the processing conditions of the photosensitive material, e.g., the timing of insertion of each photosensitive material in a case where a plurality of photosensitive materials are processed. That is, the degree of fluctuation of the surface temperature differs in cases where the plurality of photosensitive materials are inserted continuously without pauses and in cases where they are inserted with arbitrary intervals of time. Since the deviation from the targeted temperature thus differs, the finished quality after drying is not constant. Furthermore, there has been a problem in that, in cases where a plurality of photosensitive materials of different types, such as a plurality of photosensitive materials having different drying properties, are inserted in mixed form, the finished quality after drying sometimes differs depending on the types of photosensitive material.

Furthermore, with the progress made in the field of electronics, speedy processing has been required in the field of silver halide photography as well. There has been a growing demand for speedy processing of such photosensitive materials as graphic arts photosensitive materials, photosensitive materials for scanners, and X-ray photosensitive materials, in particular. The speedy processing referred to herein means processing in which the time duration from the time a leading end of the photosensitive material is inserted into a photosensitive material processor, such as an automatic processor, until the time the leading end of the photosensitive material is discharged from a drying station after passing through a processing station consisting of a developing tank, a fixing tank, a washing tank, etc., and the drying station is, for instance, 20 to 60 seconds. If the transporting speed of the photosensitive material is merely made faster to reduce the processing time of the processing and drying stations, various problems such as faulty fixation and faulty drying occur.

With respect to the faulty fixation, a technique is known in which the concentration of thiosulfate in the fixing solution is increased so as to increase the fixing speed. In addition, a technique in which a hardening agent such as water soluble aluminum salts is contained in the fixing solution is also known and widely practiced. However, if the photosensitive material is processed with the fixing solution containing the hardening agent such as water soluble aluminum salts, the fixing speed is delayed due to the hardening action. Therefore, if an attempt is made not to virtually contain the hardening agent in the fixing solution so as to increase the fixing speed, the swelling rate of the emulsion coated on the photosensitive material becomes disadvantageously large, resulting in deteriorated drying properties. Thus, reducing the quantity of the water soluble aluminum salts, i.e., the hardening agent, in the fixing solution improves the fixing speed, but acts disadvantageously in terms of the reduction of the drying time which is important in speedy processing. Accordingly, there have been practically no attempts to process the photosensitive materials by using the fixing solutions which virtually do not contain the hardening agents.

Here, to realize speedy processing, it is effective to dry the photosensitive material processed with a fixing agent which virtually does not contain the hardening agent, by means of the heat roller. However, a defect similar to the above-described one occurs if the temperature adjustment of the heat roller is effected by the so-called on-off control in which control is effected by detecting the surface temperature of the heat roller and by turning on and off the heater in correspondence with the temperature difference with respect to a set temperature such that the surface temperature of the heat roller becomes the set temperature.

The drier of the type in which drying is effected by winding the photosensitive material around a heat roller has a plurality of heat rollers, and obverse and reverse surfaces of the photosensitive material are respectively wound around different heat rollers so as to dry both surfaces. Furthermore, a temperature sensor is provided for each heat roller, and control of the surface temperature of each heat roller is effected independently. More specifically, the temperatures detected by the temperature sensors are retrieved at a fixed timing, a time duration for supplying power is determined for each heater so that the surface temperature of each heat roller can be maintained at the set temperature, and relays and the like provided between the heaters and a power source are controlled so that power is supplied to the heaters for the aforementioned time durations of power supply.

However, with the above-described temperature control, there are cases where power is supplied simultaneously to the heaters depending on the lengths of the durations of power supply for the respective heaters. For example, in FIG. 16A, power supply to a heater S1 is started with a fixed period, and power supply to a heater S2 is started independently of the period of power supply to the heater S1. In cases where, for instance, the difference in the time when power supply to the respective heaters is started is small, if the time duration of power supply to the heater S1 is made longer than the difference $t_0$ in the time when power supply to the respective heaters is started so as to increase the surface temperature of the heat roller in a short time, there occurs a period when the period of power supply to the heater S1 and the period of power supply to the heater S2 overlap.

In cases where power is supplied to a plurality of heaters, the plurality of heaters are generally connected to the power source in parallel. Therefore, during the period when the power-supplying periods thus overlap, the sum of values of currents flowing across the heaters increases to a high level, as shown in FIG. 16B. In power-supplying means which consists of a power-supplying line, a power source, and the like for supplying electric power to a current load such as a heater, the allowable current of the power-supplying line, the capacity of the power source, and so on are generally set by taking into consideration the peak value of current flowing across the load. In conventional driers, a plurality of heaters are electrically connected to the power-supplying means, and in some driers a plurality of heaters are arranged on the inner periphery of each heat roller. Since the power-supplying means may possibly supply electric power simultaneously to the plurality of heaters, the peak value of current flowing across the plurality of heaters becomes very high, as described above.

Accordingly, it is necessary to increase the allowable current of the power-supplying line of the power-supplying means and increase the capacity of the power source. Also, it is necessary prepare power-supplying systems in a number equal to or greater than the number of the heat rollers in the case where a plurality of heaters are arranged within each heat roller. Hence, the power-supplying means has been high in cost.

SUMMARY OF THE INVENTION

In view of the above-described circumstances, it is an object of the present invention to provide a drier apparatus for drying sheets of photosensitive material capable of drying a photosensitive material on a stable basis.

Another object of the present invention is to provide a drier apparatus for drying sheets of photosensitive material capable of controlling a peak value of the su/n of currents flowing across a plurality of heaters.

In accordance with a first aspect of the invention, there is provided a drier apparatus for drying sheets of photosensitive material processed with processing solutions while the photosensitive material is being transported, comprising: a roller driven to rotate for transporting the photosensitive material along a transport passage and for drying the photosensitive material by heating the photosensitive material; heating means for heating the surface of the roller; temperature detecting means for detecting a surface temperature of the roller; and control means for controlling the heating means such that a range of fluctuation of the surface temperature of the roller falls within a predetermined range of values, on the basis of a change with time of the surface temperature of the roller detected by the temperature detecting means.

In accordance with a second aspect of the invention, there is provided a drier apparatus for drying sheets of photosensitive material processed with processing solutions while the photosensitive material is being transported, comprising: roller means disposed in a transport passage for transporting the photosensitive material and for drying the photosensitive material by heating the photosensitive material; heating means for heating the roller means; temperature detecting means for detecting a surface temperature of the roller means; and control means for controlling the heating means such that a range of fluctuation of the surface temperature of the roller means falls within a predetermined range of values, on the basis of a change with time of the surface temperature of the roller means detected by the temperature detecting means and on the basis of processing information on the photosensitive material.

In the first and second aspects of the invention, the control means preferably controls the heating means by PID control in such a manner that the range of fluctuation of the surface temperature of the roller falls within the predetermined range of values.

In accordance with a third aspect of the invention, there is provided a drier apparatus for drying sheets of photosensitive material processed with processing solutions while the photosensitive material is being transported, comprising: a plurality of rollers disposed along a transport passage for transporting the photosensitive material and for drying the photosensitive material by heating the photosensitive material; a plurality of heaters disposed in correspondence with the plurality of rollers and adapted to heat the surface of the rollers as electric power is supplied to the plurality of heaters; temperature detecting means for detecting the surface temperature of each of the plurality of rollers; power supplying means for supplying power to each of the plurality of heaters; and control means for operating the power supplying means for each predetermined period on the basis of the surface temperature of each of the plurality of rollers detected by the temperature detecting means and for controlling the power supplying means such that periods of supplying power to the plurality of heaters do not overlap.

In the third aspect of the invention, the control means may control the power supplying means by dividing a power-suppliable period of each of the plurality of heaters for each predetermined period such that the periods of supplying power to the plurality of heaters do not overlap.

In addition, in the third aspect of the invention, the control means may set in advance the order of priority of the power-supplying periods for the plurality of heaters, and may control the power supplying means in such a manner as to supply power sequentially beginning with a heater of a highest order and then heaters of lesser orders among the plurality of heaters for each predetermined period.

In accordance with the first aspect of the invention, the roller for transporting the photosensitive material is heated by the heating means, the surface temperature of the roller is detected by the temperature detecting means, and the heating means is controlled by the control means on the basis of a change with time of the surface temperature detected, thereby allowing the range of fluctuation of the surface temperature of the roller to fall within a predetermined range of values. To make the range of fluctuation of the surface temperature of the roller fall within the predetermined range of values can be realized by controlling the heating means by the controlling means by using PID control, for example. In addition, since the range of fluctuation of the surface temperature of the roller is controlled to within a predetermined range of values, the photosensitive material is constantly heated at a substantially constant temperature, so that the photosensitive material can be dried on a stable basis.

In addition, as in the second aspect of the invention, the heating means for heating the roller can be controlled by the control means on the basis of a change with time of the surface temperature of the roller detected by the temperature detecting means and on the basis of processing information on the photosensitive material in such a manner that the range of fluctuation of the surface temperature of the roller falls within a predetermined range of values.

As the processing information on the photosensitive material, it is possible to use, among others, information representing insertion timings at which the plurality of photosensitive materials are inserted and types of the photosensitive materials inserted into the drier apparatus. By using such processing information, the temperature is controlled on the basis of, for instance, insertion timings in such a manner that the range of fluctuation of the surface temperature of the roller falls within a predetermined range of values. In addition, the modes of control can be changed over in accordance with the type of photosensitive material inserted so that a fixed quality of finish will be obtained irrespective of the types of photosensitive material. Thus, by controlling the surface temperature of the roller on the basis of the processing information on the photosensitive material, each photosensitive material can be dried on a stable basis even in cases where a plurality of photosensitive materials are to be dried.

In the present invention, even a photosensitive material in which the film surface of the emulsion layer has not hardened can be dried within a short period of time. Namely, it is possible to speedily dry photosensitive materials processed with a fixing solution which virtually does not contain a hardening agent. It goes without saying that photosensitive materials processed with a fixing solution containing a hardening agent can be dried satisfactorily.

In the third aspect of the invention, the power supplying means is operated for a predetermined period on the basis of the surface temperature of each roller detected by the temperature detecting means. At the same time, the power supplying means is controlled in such a manner that the power-supplying periods for the respective heaters do not overlap. To ensure that the periods of power supply to the heaters do not overlap can be realized if the predetermined period is fixed, and if the periods of power supply to the respective heaters are distributed in each predetermined period—more specifically, if each predetermined period is divided into sections by the number of the heaters provided—and the sections thus obtained are made to correspond to the respective heaters, so as to effect the power supply to the heaters within the corresponding sections. In addition, the aforementioned attempt can be realized by providing an arrangement in which the order of supplying power to the heaters is determined in advance, the heaters to which power is to be supplied in the predetermined period are changed over sequentially so as to effect the power supply to a heater of a lower order after the power supply to a heater of a higher order is completed. As a result, it is possible to control the peak value of the sum of electric currents flowing across the heaters to a low level. Accordingly, the power supplying means for suppling power to the plurality of heaters can be constituted by supply lines of a small allowable current, a power source with a small capacity, and the like.

Next, a description will be given of fixing agents and hardening agents which can be used in the photosensitive material processor having the above-described drier in accordance with the present invention.

For instance, as the fixing agents used in the present invention, it is possible to use thiosulfate and thiocyanate as well as organic sulfur compounds whose effects as fixing agents are known.

As hardening agents in the fixing solution, it is possible to cite aqueous aluminum salts, which include aluminum sulfate, aluminum ammonium sulfate, potassium aluminum sulfate, and aluminum chloride.

Here, the processing with a fixing solution which virtually does not contain a hardening agent means that a measure is provided such that a hard film of the emulsion surface of the photosensitive material immersed in the fixing solution virtually does not form. More specifically, this means that the quantity of aqueous aluminum salts added to the fixing solution is preferably set to 0–0.01 mol/litter, more preferably 0–0.005 mol/litter. Consequently, the processing time in fixation processing can be reduced, and the residual coloration of the photosensitive material after being processed can be reduced since the efficiency in washing improves. As the pH of the fixing solution, 5.3 or more is preferable, and 5.5–7.0 is more preferable.

As the quantity of sulfite in the fixing solution, 0.05–1.0 mol/litter is preferable, and 0.07–0.8 mol/litter is more preferable.

Fixing agents for the fixing solutions that can be used in the present invention include, in addition to the aforementioned compounds, various acids, salts, chelating agents, surface active agents, wetting agents, fixation accelerators, and other additives.

As acids, it is possible to cite, for example, inorganic acids such as sulfuric acid, hydrochloric acid, nitric acid, and boric acid, and organic acids such as formic acid, propionic acid, oxalic acid, and phthalic acid.

As salts, it is possible to cite, for instance, salts of lithium, potassium, sodium, and amonium of these acids.

As chelating agents, it is possible to cite, among others, anionic surface active agents such as sulfates and sulfonic compounds, nonionic surface active agents produced from such as polyethylene glycol and esters, and amphoteric surface active agents disclosed in Japanese Patent Application Laid-Open No. 6840/1982.

As wetting agents, it is possible to cite, for instance, alkanoleunine, alkylene glycol, and the like.

As fixation accelerators, it is possible to cite, for instance, thiourea derivatives disclosed in Japanese Patent Application Publication No. 35754/1970 and Japanese Patent Application Laid-Open Nos. 122535/1983 and 122536/1983, alcohols having a triple bond in molecules, and thioethers disclosed in U.S. Pat. No. 4,126,459.

Among the above-described additives, acids and salts, such as boric acid and aminopolycarbonates, are preferable since they exhibit advantageous effects in promoting the object of the present invention. More preferably, a fixing agent containing boric acid (salt) is used. The amount of boric acid (salt) to be added is preferably 0.5–20 g/litter, more preferably 4–5 g/litter.

The present invention can be applied to various photosensitive materials including photosensitive materials for printing and X-ray photosensitive materials.

In accordance with the first aspect of the invention, as described above, the surface temperature of a roller which is heated by the heating means and is adapted to transport the photosensitive material is detected, and the heating means is controlled on the basis of the detected change with time of the surface temperature of the roller such that the range of fluctuation of the roller surface temperature falls within a predetermined range of values. Accordingly, it is possible to obtain an outstanding advantage in that a plurality of photosensitive materials can be dried substantially uniformly on a stable basis.

In accordance with the second aspect of the invention, as described above, the surface temperature of a roller which is heated by the heating means and is adapted to transport the photosensitive material is detected, and the heating means is controlled on the basis of the detected change with time of the surface temperature of the roller and processing information on the photosensitive material such that the range of fluctuation of the roller surface temperature falls within a predetermined range of values. Accordingly, it is possible to obtain the outstanding advantage that a plurality of photosensitive materials can be dried substantially uniformly on a stable basis.

In accordance with the third aspect of the invention, as described above, the power-supplying means is operated for each predetermined period on the basis of the surface temperature of each roller, and the power-suppling means is controlled in such a manner that the power-supplying periods for the heaters do not overlap. Accordingly, it is possible to obtain an outstanding advantage in that the peak value of the sum of currents flowing across the plurality of heaters can be controlled to a low level.

The other objects, features and advantages of the present invention will become more apparent from the following detailed description of the invention when read in conjunction with the accompanying drawings.

DESCRIPTION OF THE PREFERRED EMBODIMENTS

Referring to the accompanying drawings, a detailed description will be given of the embodiments of the present invention.

FIRST EMBODIMENT

Figure 1:
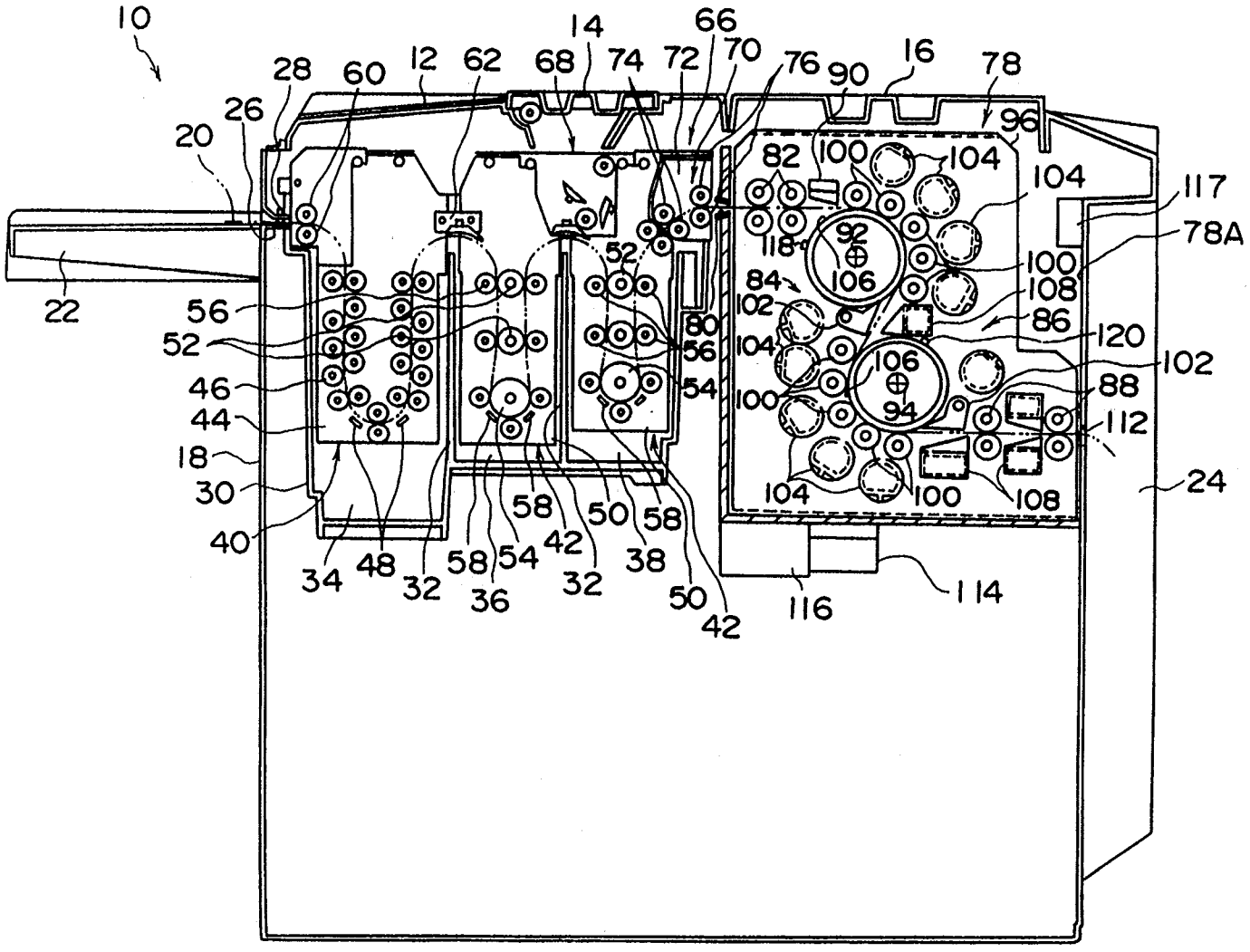
FIG. 1 is a side elevational view illustrating a schematic configuration of a photosensitive material processor in accordance with a first embodiment.

First, a description will be given of a first embodiment of the present invention. FIG. 1 schematically shows a side elevational view of a photosensitive material processor 10 having a drier apparatus in accordance with the first embodiment.

Cover elements 12, 14, ad 16, which are portions of an openable body cover for shielding the light from the outside, are provided on top of a casing 18 of the photosensitive material processor 10. An insertion tray 22 for inserting photosensitive materials 20 is mounted at an end of the casing 18, while a stocker 24 for storing processed photosensitive materials 20 is mounted at the other end thereof. In addition, an insertion port 26 into which the photosensitive materials 20 are inserted is formed in the casing 18 in the vicinity of the insertion tray 22, and a detector 28 for detecting the inserted photosensitive material 20 is mounted in the vicinity of the insertion port 26.

Figure 3:
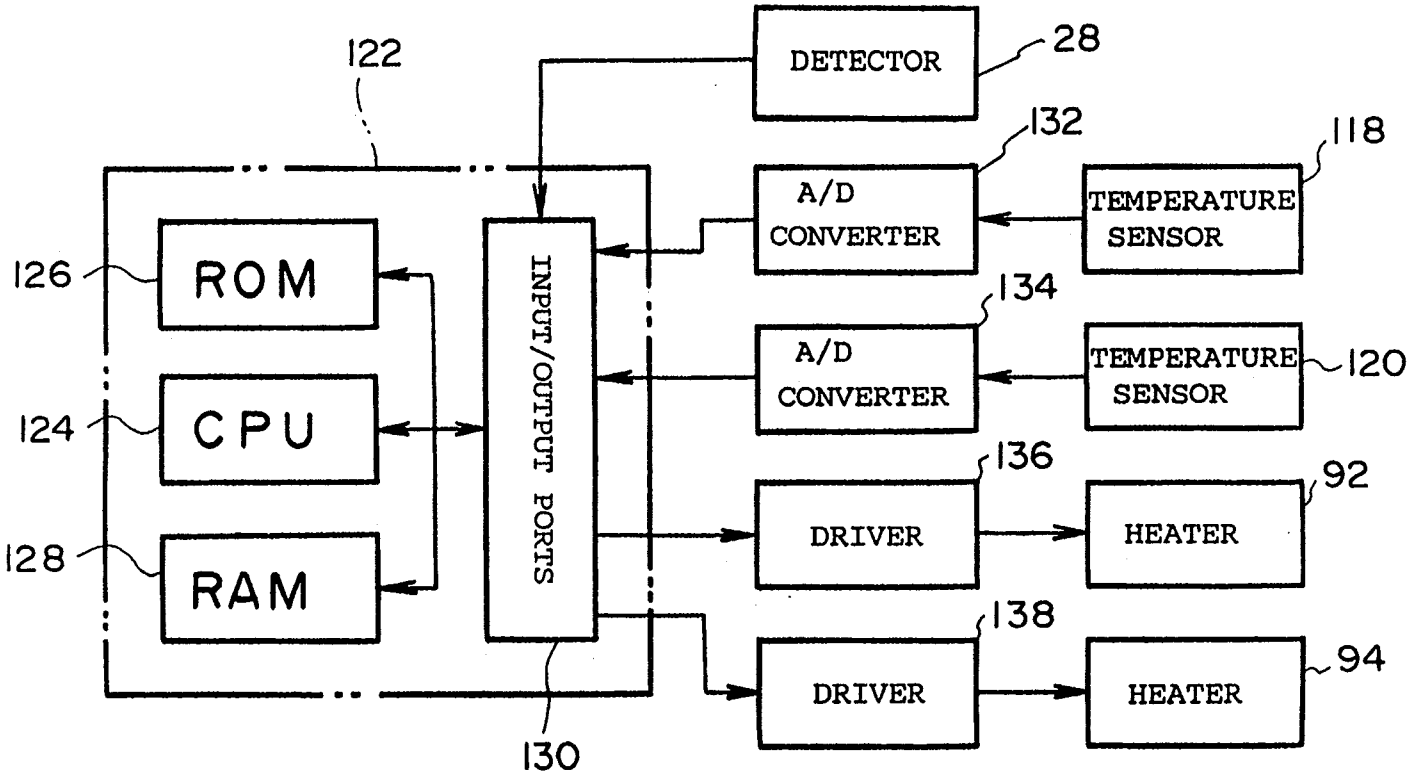
FIG. 3 is a schematic block diagram of a control circuit and its peripheral equipment in accordance with the first embodiment.

The detector 28 is arranged such that a plurality of pairs of a light-emitting element and a light-receiving element disposed in face-to-face relation with a photosensitive material transport passage placed therebetween are arrayed in the vicinity of the photosensitive material insertion port 26 along the widthwise direction of the photosensitive material 20. As rays of light emitted from the light-emitting elements are shielded by the photosensitive material 20, the light-receiving elements are turned on and off in correspondence with the width and length of the inserted photosensitive material 20. The detector 28 is connected to input/output ports 130 of a control circuit 122 (see FIG. 3). It should be noted that the detector 28 may be a detector of a type which is turned on and off as the light emitted from the light-emitting elements and reflected from the photosensitive material 20 is received by the light-receiving elements.

A box-like processing tank body 30 with its upper side open is disposed in the casing 18. The interior of this processing tank body 30 is partitioned by partition walls 32, and a developing tank 34, a fixing tank 36, a washing tank 38 are formed therein in order. The depth of the developing tank 34 is made greater than the depth of the fixing tank 36 and the washing tank 38. in addition, the depth of the fixing tank 36 is made the same as the depth of the washing tank 38. A transport rack 40 is disposed in the developing tank 34 by being inserted therein, while transport racks 42 are disposed in the fixing tank 36 and the washing tank 38.

As shown in FIG. 1, the transport rack 40 has a pair of side plates 44 (only one side plate being shown in FIG. 1), and a plurality of rotatably supported transport rollers 46 are disposed between the pair of side plates 44. The transport rollers 46 rotate as a driving force of an unillustrated driving means is imparted thereto to transport the photosensitive material 20. In addition, a pair of guides 48 for inverting the direction of travel of the photosensitive material 20 are disposed at the bottom of the transport rack 40. This transport rack 40 downwardly transports the photosensitive material 20 inserted into the developing tank 34 to the bottom, and then inverts and upwardly transports the photosensitive material 20 toward the top of the developing tank 34 so as to feed it out from inside the developing tank 34. As a result, the photosensitive material 20 is subjected to development processing by a developing solution stored in the developing tank 34.

Each transport rack 42 has a pair of side plates 50 (only one side plate being shown in FIG. 1). Rotatably supported by the side plates 50 are a pair of upper and lower rollers 52, a large-diameter roller 54 disposed below the lower roller 52, and small-diameter rollers 56 abutting against the rollers 52 and 54. In addition, a pair of guides 58 for inverting the photosensitive material 20 are disposed at the bottom the transport rack 42. The driving force of the unillustrated driving means is imparted to the rollers 52, 54, and 56 to nip and transport the photosensitive material 20. This transport rack 42 downwardly transports the photosensitive material 20, fed into the fixing tank 36 or the washing tank 38, to the bottom, and then inverts and upwardly transports the photosensitive material 20 so as to feed it out from inside the fixing tank 36 or the washing tank 38. As a result, the photosensitive material 20 transported through the fixing tank 36 undergoes fixation by a fixing solution stored in the fixing tank 36, while the photosensitive material 20 transported through the washing tank 38 is subjected to washing with washing water stored in the washing tank 38.

A pair of transport rollers 60 are disposed in the developing tank 34 on the insertion port 26 side. The photosensitive material 20 inserted into the casing 18 through the insertion port 26 is nipped by this pair of transport rollers 60 and is fed into the developing tank 34. In addition, located between the developing tank 34 and the fixing tank 36 is an upper inversion guide 62 for downwardly inverting the photosensitive material 20 fed from inside the developing tank 34 and for guiding the same into the fixing tank 36. Also, located between the fixing tank 36 and the washing tank 38 is a crossover rack 68 for downwardly inverting the photosensitive material 20, fed from inside the fixing tank 36, toward the washing tank 38 so as to be subjected to wash processing.

As shown in FIG. 1, a squeezing section 66 is disposed in the washing tank 38 on the downstream side as viewed in the direction of travel of the photosensitive material 20, and a drier 78 in accordance with this first embodiment is disposed on the downstream side of the squeezing section 66. A squeeze rack 70 is disposed in the squeeze section 66. This squeeze rack 70 is comprised of a pair of side plates 72 (only one side being shown in FIG. 1) and transport roller pairs 74 and 76 disposed between the side plates 72 and supported rotatably. The driving torque of the unillustrated driving means is imparted to the transport roller pairs 74 and 76, so as to nip and transport the photosensitive material 20, fed out from inside the washing tank 38, toward the drier 78. As a result, the washing water adhering to the photosensitive material 20 is squeezed off.

Figure 2:
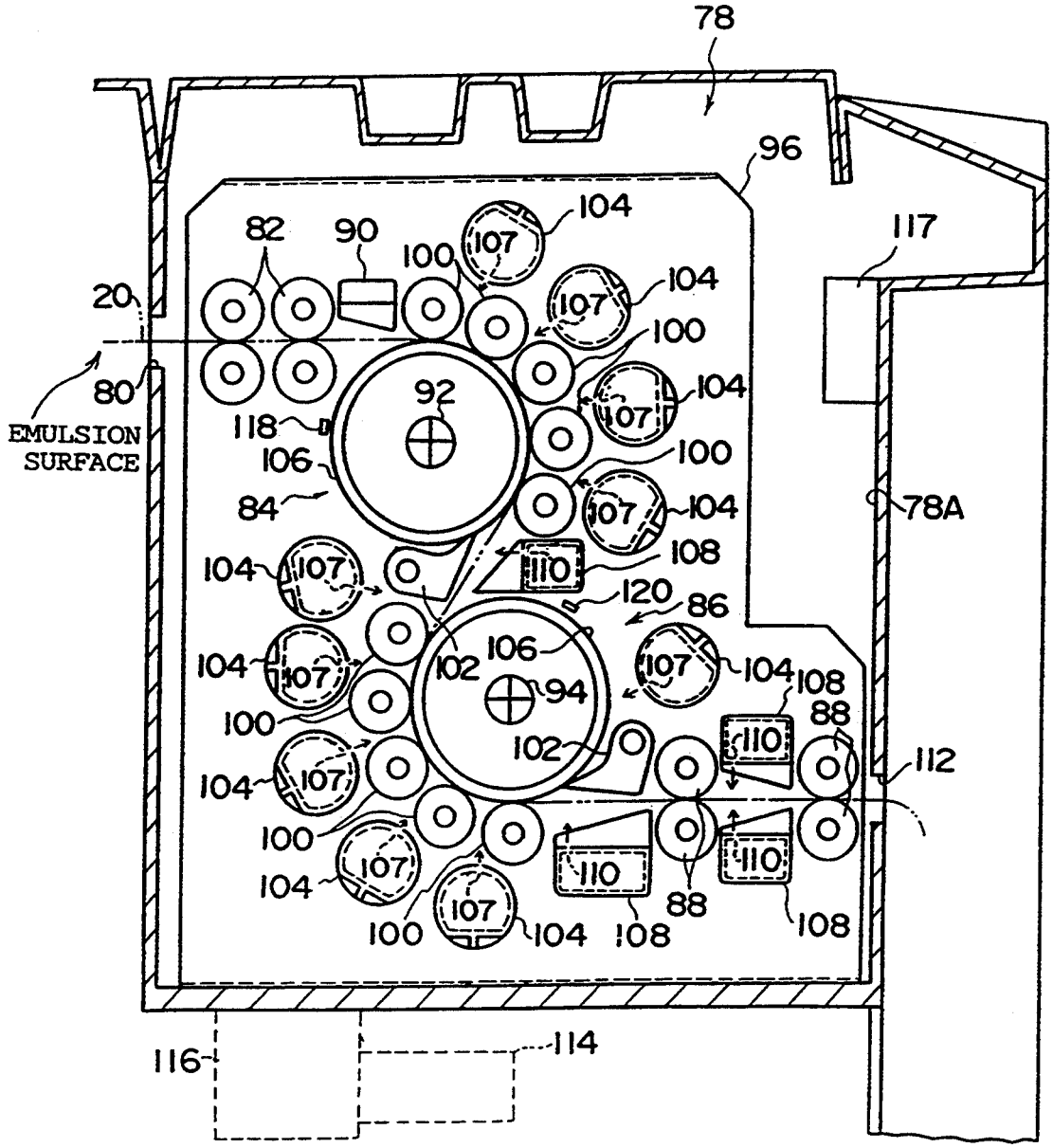
FIG. 2 is a side elevational view illustrating a schematic configuration of a drier in accordance with the first embodiment.

As shown in FIGS. 1 and 2, the photosensitive material 20 is inserted into a drying chamber 78A of the drier 78. A pair of side plates 96 (only one being shown in FIGS. 1 and 2) are disposed in the drying chamber 78A, and two pairs of squeeze rollers 82, a first heat roller 84, a second heat roller 86, and two pairs of discharge rollers 88 are rotatably supported by the pair of side plates 96 along the transport passage of the photosensitive material 20. The squeeze roller pairs 82 are adapted to squeeze off water adhering to the photosensitive material 20 while nipping and transporting the photosensitive material 20, and guide the photosensitive material 20 onto an outer periphery of the first heat roller 84 by means of a guide 90 disposed on the downstream side of the squeeze roller pairs 82.

The first heat roller 84 and the second heat roller 86 are arranged substantially vertically within the drying chamber 78A, and a photosensitive material transporting passage for transporting the photosensitive material 20 wound around the outer peripheries thereof is formed. A rod-like infrared heater 92 serving as a heating means is concentrically disposed in an axial portion of the first heat roller 84, while a rod-like infrared heater 94 serving as a heating means is concentrically disposed in an axial portion of the second heat roller 86. The infrared heaters 92 and 94 are electrically connected to drivers 136 and 138 (see FIG. 3), respectively, and are operated when electric power is supplied thereto from the drivers so as to heat roller bodies 106 of the heat rollers by means of their radiant heat.

In addition, a plurality of nip rollers 100 are disposed on the outer peripheries of the first and second heat rollers 84 and 86. The nip rollers 100 and the outer peripheral surfaces of the heat rollers 84 and 86 are adapted to nip the photosensitive material 20 wound around the heat rollers 84 and 86. As the photosensitive material 20 is brought into contact with the outer peripheral surfaces of the heat rollers 84 and 86 is heated by the infrared heaters 92 and 94, the photosensitive material 20 is heated by heat conduction and is dried.

A release guide 102 is disposed on the downstream side, as viewed in the direction of travel of the photosensitive material 20, of each of the heat rollers 84 and 86. The release guide 102 has one end abutting against the outer peripheral surface of the first heat roller 84 or the second heat roller 86, and another end axially supported on the pair of side plates 96. The release guide 102 is adapted to release the photosensitive material 20 wound around each of the heat rollers 84 and 86 from the outer peripheral surface of each of the heat rollers 84 and 86 at each predetermined position. In addition, an intermediate portion of the release guide 102 projects toward the downstream side of the transport passage so as to guide the photosensitive material 20, which has been released from the outer peripheral surface of each of the heat rollers 84 and 86, toward the downstream side along the transport passage.

A plurality of hollow blow pipes 104 are disposed in the vicinities of the nip rollers on the sides thereof which are away from the sides thereof where the heat rollers 84 and 86 are located. As shown in FIG. 2, a slit 107 allowing the interior and the exterior of the blow pipe to communicate with each other is formed in that surface of each blow pipe 104 which faces the transport passage of the photosensitive material in such a manner as to extend along the widthwise direction of the photosensitive material 20. As drying air is supplied to the interior of each of the blow pipes 104, this drying air is blown uniformly through the slits 107 onto the photosensitive material 20 along the widthwise direction of the photosensitive material 20.

As shown in FIGS. 1 and 2, guides 108 are respectively located on the downstream sides of the heat rollers 84 and 86 and also between the two discharge roller pairs 88. Each of these guides 108 is adapted to guide the photosensitive material 20, which has been transported by the heat roller 84, the heat roller 86, or the discharge roller pair 88, to the downstream-side heat roller 86 or discharge roller pair 88. In addition, as shown in FIG. 2, the interior of each guide 108 is made hollow, and a slit 110 is formed therein along the widthwise direction of the photosensitive material 20. As drying air is supplied to the interior of each of the guides 108, this drying air is blown uniformly through the guides 108 onto the photosensitive material 20 along the widthwise direction of the photosensitive material 20.

By means of the drying air blown through the blow pipes 104 and the guides 108, the high-humidity air stagnating in the vicinity of the surfaces of the photosensitive material 20 is removed, and the drying of the photosensitive material 20 is promoted. The high-humidity air removed from the vicinity of the surfaces of the photosensitive material 20 is discharged to outside the apparatus by means of a fan 117. The photosensitive material 20 which has undergone dry processing in the drying chamber 78A is discharged to outside the casing 18 of the photosensitive material processor 10 via a discharge port 112.

A fan 114 and a heater 116 for producing drying air are disposed below the drying chamber 78A and produce the drying air. This drying air is supplied to the interiors of the aforementioned blow pipes 104 and guides 108 via unillustrated ducts. It should be noted that, instead of providing the heater 116, air outside the photosensitive material processor 10 may be supplied to the interior of the drying chamber 78A by means of the fan 114 via the blow pipes 104 and the guides 108. Alternatively, by circulating most of the air in the drying chamber 78A by means of the fan 114 and by partially introducing the air outside the apparatus, the air may be supplied to the interior of the drying chamber 78A via the blow pipes 104 and the guides 108. In addition, a temperature sensor 118 is disposed in the vicinity of the outer periphery of the first heat roller 84 inside the drying chamber 78A, while a temperature sensor 120 is disposed in the vicinity of the outer periphery of the second heat roller 86 as well. A surface temperature $\theta_{H1}$ of the outer periphery of the first heat roller 84 is detected by the temperature sensor 118, while a surface temperature $\theta_{H2}$ of the outer periphery of the second heat roller 86 is detected by the temperature sensor 120.

The temperature sensors 118 and 120 are connected to the input/output ports 130 of the control circuit 122 via A/D converters 132 and 134, respectively. The control circuit 122 is comprised of a CPU 124, a ROM 126, a RAM 128, and the input/output ports 130, all of which are connected to each other via buses and the like. A set value $\theta_1$ of the surface temperature of the first heat roller 84 and a set value $\theta_2$ of the surface temperature of the second heat roller 86 are stored in advance in the ROM 126. In addition, the aforementioned drivers 136 and 138 are connected to the input/output ports 130.

In the power-supplying-period setting processing which will be described later, the control circuit 122 determines a power-supplying period $t_1$ of the infrared heater 92 for setting the temperature of the first heat roller 84 to the set value $\theta_1$ as well as a power-supplying period $t_2$ of the infrared heater 94 for setting the temperature of the second heat roller 86 to the set value $\theta_2$. The control circuit 122 sets these power-supplying periods $t_1$ and $t_2$ to the respective drivers 136 and 138. The drivers 136 and 138 supply electric power to the infrared heaters 92 and 94 for the set power-supplying periods $t_1$ and $t_2$, respectively.

Here, the set value $\theta_1$ of the surface temperature of the first heat roller 84 is set to such a temperature level (approx. 70° C.) that, when the photosensitive material 20 is inserted through the insertion port 26 with the surface on which an emulsion layer is formed (hereafter referred to as the emulsion surface) facing down, the emulsion surface of the photosensitive material 20 does not stick to the first roller, and the surface of the photosensitive material 20 away from the surface thereof where the emulsion layer is formed (hereafter referred to as the back surface) does not stick to the nip rollers 100. When the photosensitive material 20 is wound around the second heat roller 86, both the emulsion surface and the back surface of the photosensitive material 20 have already been dried to some extent. Accordingly, the set value $\theta_2$ of the surface temperature of the second heat roller 86 can be set to a level higher than the set value $\theta_1$ of the surface temperature of the first heat roller 84, and in this embodiment the set value $\theta_2$ of the surface temperature of the second heat roller 86 is set to about 80° C. As the set values of the surface temperatures of the first and second heat rollers 84 and 86 are thus set, the photosensitive material 20 can be dried speedily without sticking to the first and second heat rollers 84 and 96.

Next, a description will be given of the operation of the first embodiment. When the photosensitive material 20 is inserted into the casing 18 through the insertion port 26, the photosensitive material 20 is detected by the detector 28, and a detected signal is inputted to the control circuit 122. The inserted photosensitive material 20 is nipped by the transport roller pair 60 and is transported to the interior of the developing tank 34, and after it is transported downwardly by the transport rack 40, the photosensitive material 20 is transported upwardly and is fed out from inside the developing tank 34. As a result, the photosensitive material 20 is immersed in the developing solution in the developing tank 34 and is thereby subjected to development processing. The photosensitive material 20 fed out from inside the developing tank 34 is inverted downwardly by the upper inversion guide 62 and is fed into the fixing tank 36.

The photosensitive material 20 fed into the fixing tank 36 is downwardly transported by the transport rack 42, and is then upwardly transported and is fed out from inside the fixing tank 36. As a result, the photosensitive material 20 is immersed in the fixing solution in the fixing tank 36 and is thereby subjected to fixation processing. The photosensitive material 20 fed out from the fixing tank 36 is downwardly inverted by the crossover rack 68, and is fed into the washing tank 46. The photosensitive material 20 fed into the washing tank 38 is transported downwardly by the transport rack 42 and is then inverted and subjected to wash processing with the washing water before it is transported to the squeezing section 66.

The photosensitive material 20 transported to the squeezing section 66 has its water adhering thereto in the washing tank 38 squeezed off, and is transported to the interior of the drier 78. The photosensitive material 20 for which wash processing has been completed in the washing tank 38 is inserted into the drying chamber 78A of the drier 78, and is transported through the drying chamber 78A, thereby undergoing dry processing.

Namely, when the photosensitive material 20 is in serted through the insertion port 24 with the emulsion surface of the photosensitive material 20 facing down, the photosensitive material 20 inserted into the drying chamber 78A, after being squeezed by the squeeze roller pairs 82, is wound around the first heat roller 84 such that the emulsion surface is brought into contact with the outer peripheral surface of the heat roller 84. The first heat roller 84 is heated by the infrared heater 92 and is controlled such that its temperature is lower than the surface temperature of the second heat roller 86 and is maintained at the predetermined temperature (for example, approx. 70° C. in terms of the surface temperature of the first heat roller 84) at which the emulsion surface and the back surface of the photosensitive material 20 do not stick to the first heat roller 84 and the nip rollers 100. For this reason, the photosensitive material 20 is heated and dried without its emulsion surface sticking to the first heat roller 84. In the state in which the photosensitive material 20 is wound around the first heat roller 84, the back surface is heated as the heat supplied from the first heat roller 84 is conducted thereto, and the drying air discharged from the blow pipes 104 located around the outer periphery of the first heat roller 84 is blown onto the back surface and is thereby dried.

The photosensitive material 20 which has been dried to some extent by passing by the first heat roller 84 is wound around the second heat roller 86 in such a manner that the back surface is brought into contact with the outer peripheral surface of the second heat roller 86. The second heat roller 86 is heated by the infrared heater 94, and is controlled such that its temperature is maintained at the predetermined temperature (for example, approx. 80° C. in terms of the surface temperature of the second heat roller 86) which is higher than the surface temperature of the first heat roller 84 through temperature control which will be described later. As described above, since the back surface has been dried to some extent after passing by the first heat roller 84, even if the temperature of the second heat roller 86 is set to a level higher than that of the first heat roller 84, the photosensitive material 20 does not stick to the second heat roller 86. The emulsion surface of the photosensitive material 20 is preheated by the first heat roller 84, and is further heated as the heat supplied from the second heat roller 86 is conducted thereto. Furthermore, as the drying air discharged through the blow pipes 104 arranged around the outer periphery of the second heat roller 86 is blown onto the emulsion surface of the photosensitive material 20, the emulsion surface of the photosensitive material 20 is dried.

Here, although the heating means is controlled such that the surface temperature of the first heat roller 84 is set to be lower than that of the second heat roller 86, an arrangement may be alternatively provided such that an amount of the photosensitive material 20 wound around the first heat roller 84 is made smaller than an amount of the photosensitive material 20 wound around the second heat roller 86, thereby adjusting the quantity of heat to which the photosensitive material 20 is subjected.

In addition, since the photosensitive material 20 is heated by being subjected to heat through heat conduction from the heat rollers 84 and 86, heat is efficiently conducted to the photosensitive material 20, and speedy dry processing can be effected even in the case of the photosensitive material processed with a fixing solution which virtually does not contain a hardening agent. Furthermore, the roller bodies 106 of the first and second heat rollers 84 and 86 are fabricated by cylinders made of aluminum and Teflon-coated, and their thickness is substantially fixed. Hence, since there is no shortcoming of the heat capacity being locally large, the surface temperature of each roller body 106 can be readily made substantially fixed over the entire length thereof through the temperature control which will be described later. Accordingly, the photosensitive material 20 is dried uniformly without occurrence of drying marks. The photosensitive material 20 dried by the drier 78 is nipped and transported by the discharge roller pairs 88, is discharged to outside the photosensitive material processor 10 through the discharge port 112, and is accommodated in the photosensitive material stocker 24.

Figure 4A:
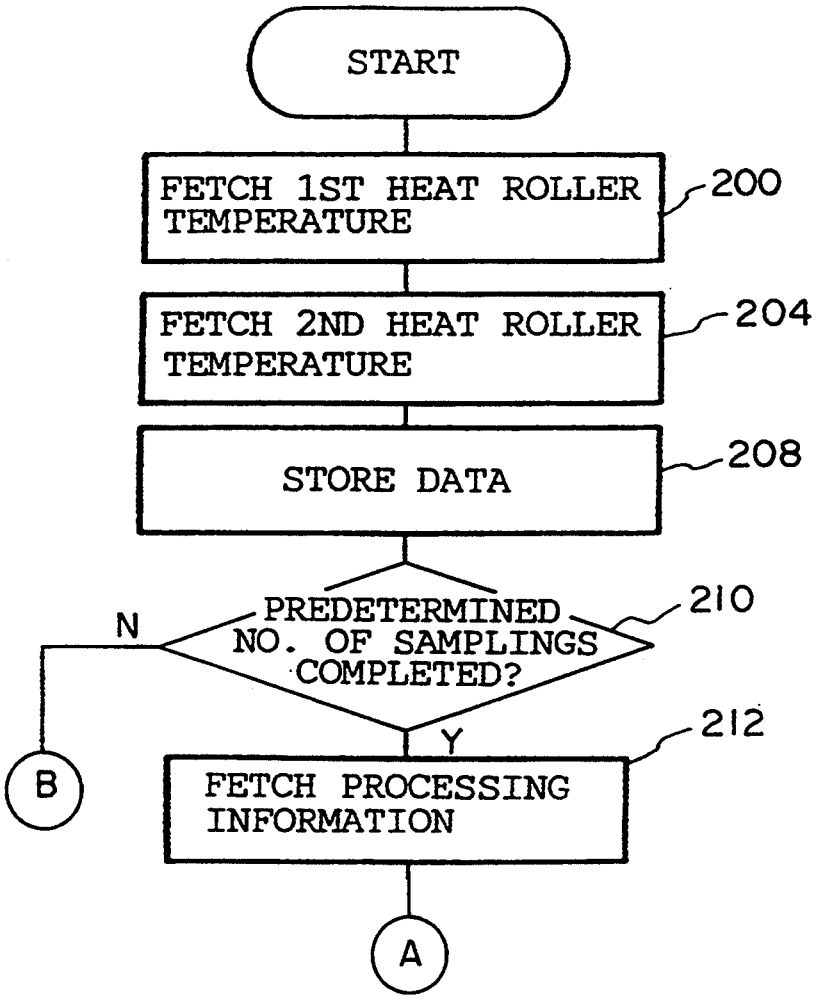
FIGS. 4A and 4B are flowcharts illustrating the operation of the first embodiment.
Figure 4B:
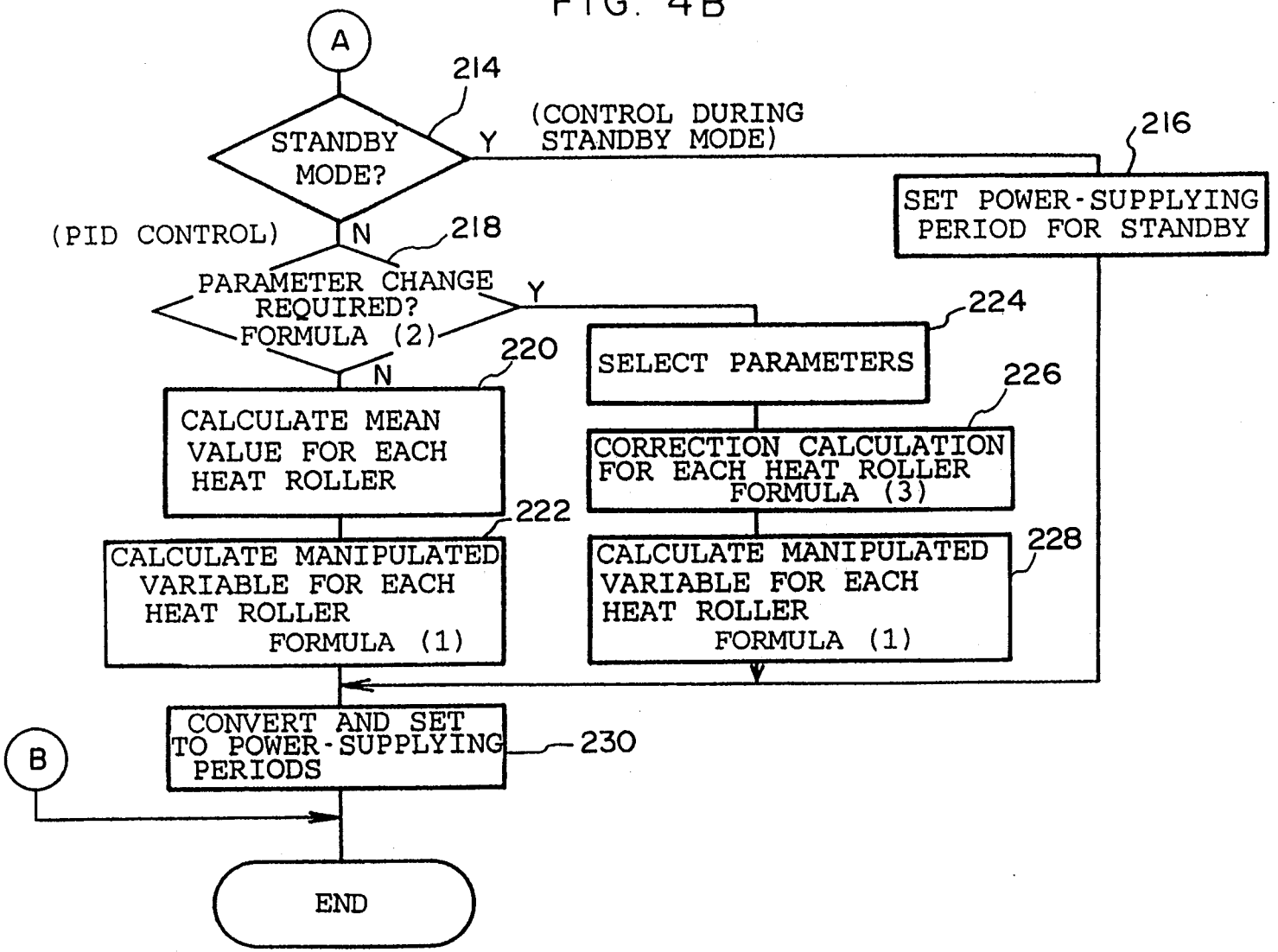

Referring now to the flowcharts of FIGS. 4A and 4B, a description will be given of the processing for setting power-supplying periods for the infrared heaters 92 and 94 as the temperature control processing for the first and second heat rollers 84 and 86. It should be noted that the flowcharts shown in FIGS. 4A and 4B are executed for each fixed sampling period $T_s$ (e.g., 500 msec), and a control period is $T_c=4\times T_s$.

In Step 200, data representing the surface temperature $\theta_{H1}$ of the first heat roller 84 detected by the temperature sensor 118 is fetched via the A/D converter 132. In Step 204, data representing the surface temperature $\theta_{H2}$ of the second heat roller 86 detected by the temperature sensor 120 is fetched via the A/D converter 134. In Step 208, the data fetched in Steps 200 and 204 are stored in the RAM 128.

Figures 5A, 5B, 5C, 5D, 5E:
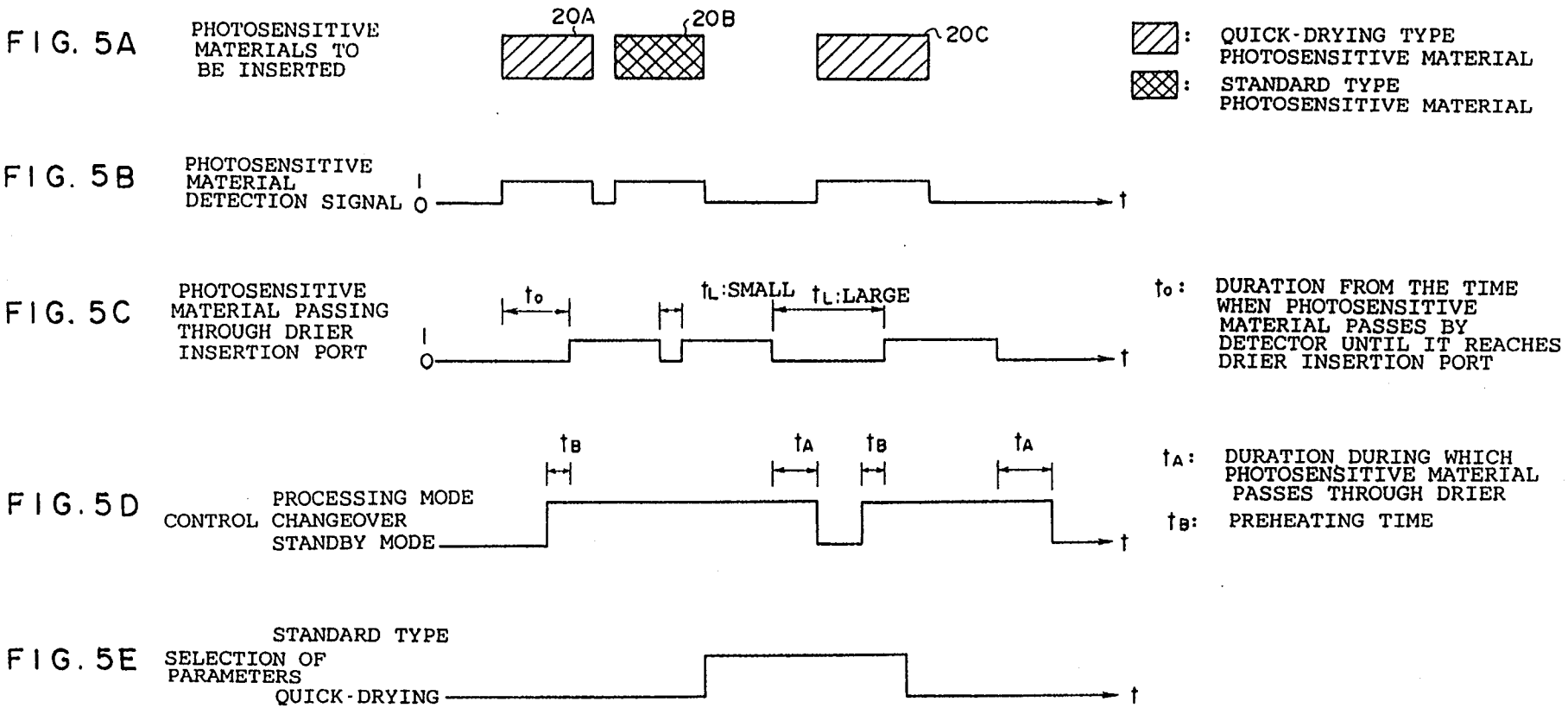
FIGS. 5A to 5E are timing charts illustrating photosensitive materials inserted into the photosensitive material processor and the processing of the inserted photosensitive materials.

In Step 210, a determination is made as to whether or not a predetermined number of samplings has been completed. If NO is the answer in the determination in Step 210, processing ends, and the operation returns to Step 200. In this embodiment, YES is given as the answer in the determination in Step 210 if the surface temperature of each heat roller is fetched four times, and the power-supplying periods $t_1$ and $t_2$ for the infrared heaters 92 and 94 are determined in Step 212 and thereafter. In Step 212, processing information, such as insertion timings of the photosensitive material 20, is fetched on the basis of the detected signal of the detector 28. For example, in a case where a photosensitive material 20A, a photosensitive material 20B, and a photosensitive material 20C are inserted through the insertion port 26 at timings shown in FIG. 5A, detected signals such as those shown in FIG. 5B are outputted from the detector 28. If the time duration during which the photosensitive material 20 reaches the insertion port 80 of the drier 78 from the position where the detector 28 is located is $t_0$, the photosensitive materials 20A, 20B, and 20C pass through insertion port 80 at timings shown in FIG. 5C.

As is apparent from FIG. 5C, the time duration from the time a trailing end of the photosensitive material 20A passes through the insertion port 80 and a leading end of the ensuing photosensitive material 20B reaches the insertion port 80 is short ($t_L$: small), while the time duration from the time the trailing end of the photosensitive material 20B passes through the insertion port 80 and a leading end of the ensuing photosensitive material 20C reaches the insertion port 80 is long ($t_L$: large). In the control circuit 122 of this embodiment, when the drier 78 is effecting the drying of the photosensitive material 20, a "processing mode" in FIG. 5D is selected so that the surface temperatures of the first and second heat rollers 84 and 86 will be maintained at their set values, and power-supplying periods are then determined by PID (Proportional plus Integral plus Derivative) control (which will be described later).

During a standby period when the photosensitive material 20 is not being dried, a standby mode is selected so that the surface temperatures of the first and second heat rollers 84 and 86 will assume predetermined values $\theta_a$ which are lower than the set values, and power-supplying periods are then determined. However, in a case where an interval between the photosensitive materials is short (e.g., 3 minutes or less) as in the processing interval for the aforementioned photosensitive material 20A and photosensitive material 20B, the "processing mode" is selected, and the determination of the power-supplying periods through the PID control is continued so that the surface temperatures of the heat rollers 84 and 86 will be maintained at their set values.

For a predetermined time duration ($t_B$ in FIG. 5D) before the leading end of the photosensitive material 20 reaches the drier 78, the control circuit 122 effects preheating through the PID control by selecting the "processing mode" so that the surface temperatures of the first and second heat rollers 84 and 86 become the set values, and continues the PID control in the processing mode until the lapse of a predetermined time duration ($t_A$ in FIG. 5D) from the time the trailing end of the photosensitive material 20 passes through the insertion port 80 until the trailing end of the photosensitive material 20 passes through the discharge port 112. Thus the photosensitive material detection signals from the detector 28 are fetched as the processing information, either the processing mode or the standby mode is selected as shown in FIG. 5D, and timings for changing over the PID control and the standby control are set.

In this Step 212, information representing the types of the photosensitive material 20 (e.g., a quick drying type, a standard type, etc.) to be subjected to dry processing may be inputted as processing information by operating an unillustrated switch or keyboard. This information may then be stored in the RAM 128, and the parameters in Step 224 (which will be described later) may be changed on the basis of that information.

In an ensuing Step 214, a determination is made as to whether or not the standby mode has been set as the present mode. If YES is the answer in the determination in Step 214, in Step 216 the power-supplying periods $t_1$ and $t_2$ for the infrared heaters 92 and 94 are set to a predetermined power-supplying period $t_s$ for the standby period, and the power-supplying periods $t_1$ and $t_2$ thus determined are outputted to the drivers 136 and 138, respectively. Consequently, the infrared heaters 82 and 94 are turned on during the on time $t_s$ for the respective standby period within a control period $T_c$, so that the surface temperatures of the heat rollers 84 and 86 are maintained at the predetermined values $\theta_a$ which are lower than the set values $\theta_1$ and $\theta_2$.

Figure 6A:
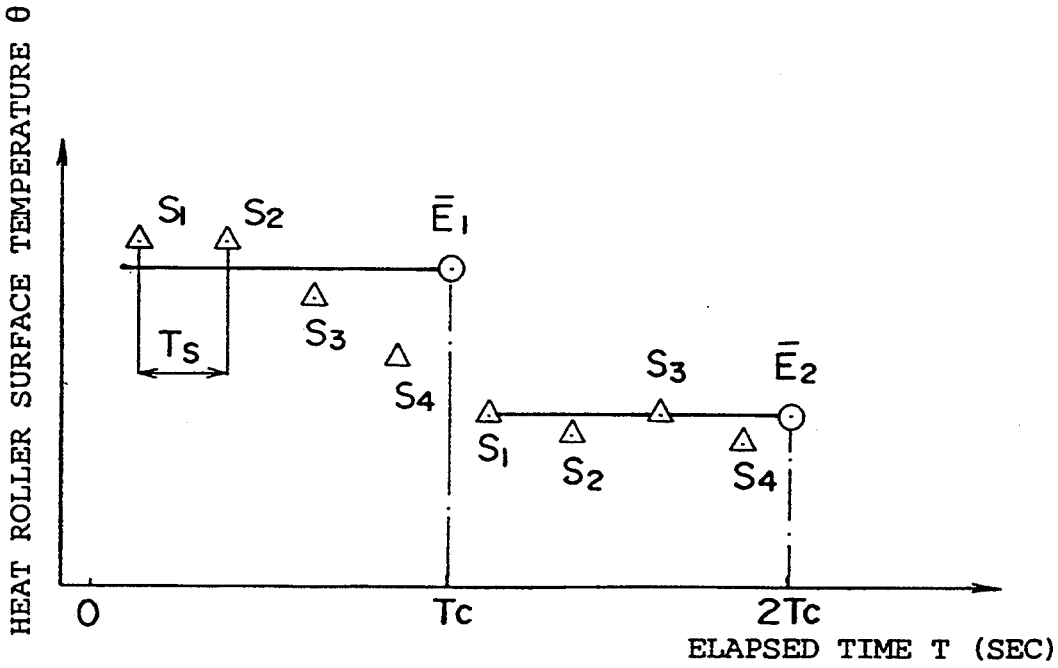
FIG. 6A is a graph illustrating the calculation of means values.

Meanwhile, if NO is the answer in the determination in Step 214, the setting of power-supplying periods for the heaters through the PID control in the processing mode is effected in Step 218 and thereafter. In Step 218, a determination is made as to whether or not the change of the parameters is required. The meanings of the parameters and change thereof will be described later. If NO is given as the answer in the determination in Step 218, the operation proceeds to Step 220. In this Step 220, in a case where, for instance, a photosensitive material of a quick drying type, which exerts less influence on the surface temperatures of the heat rollers, is dried by the heat rollers, as shown in FIG. 6A, a mean value of the data (e.g., samples $S_1 \ldots, S_4$) stored in Step 208 is calculated, and on the basis of this value a deviation $E_1$ with respect to each of the set values $\theta_1$ and $\theta_2$ of the surface temperatures of the heat rollers 84 and 86 is calculated for each heat roller. In an ensuing Step 222, a controlled variable $Y_n$ is determined for each heat roller on the basis of the deviation $E_1$ thus calculated. The manipulated variable $Y_n$ is obtained from the following Formula (1):

$$Yn\text{-}Kp\{En+Gi\Sigma Em+Gd(En-En\text{-}1)\}+Ys \ldots (1)$$

where, $K_p=100/P_b$ $G_p=T_c/T_i$ $G_p=T_d/T_c$ and, $E_n$: deviation during an n-th sampling $P_b$: proportional band (%)

$T_i$: integral time (sec)

$T_d$: derivative time (sec)

$T_c$: control period (sec)

$Y_s$: manipulated variable when differential $E=0$

The manipulated variable $Y_n$ of each of the infrared heaters 92 and 94 can be calculated by substituting the data for each heat roller into Formula (1) above. In Step 230, the manipulated variables $Y_n$ are converted to the power-supplying periods $t_1$ and $t_2$ and are outputted to the drivers 136 and 138. As a result, the infrared heaters 92 and 94 are turned on for the power-supplying periods $t_1$ and $t_2$, respectively, within the control period $T_c$ such that the surface temperature of the infrared heater 92 is set to the set value $\theta_1$, and the surface temperature of the infrared heater 94 to the set value $\theta_2$.

Figure 7A:
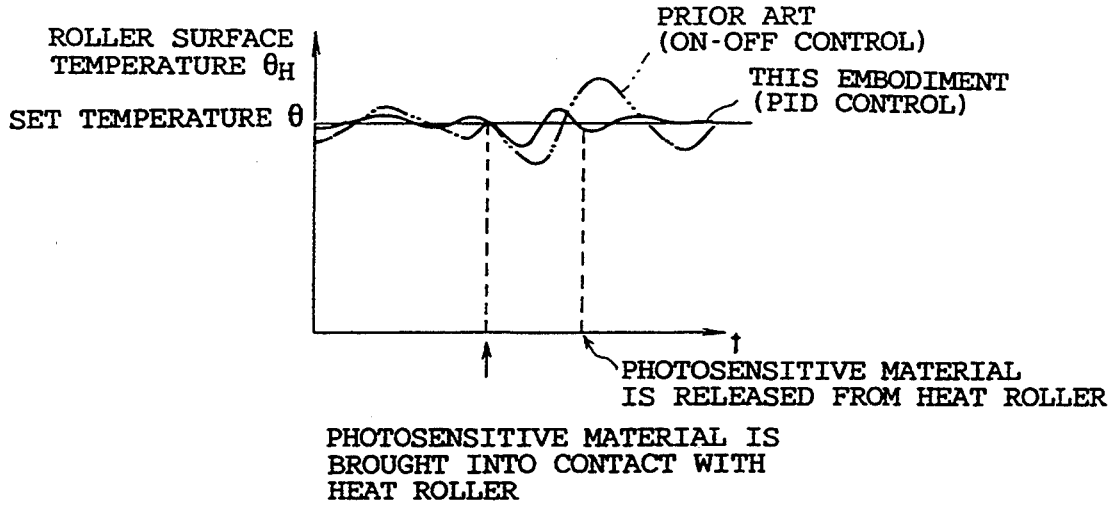
FIGS. 7A and 7B are graphs in which fluctuations in the surface temperatures of heat rollers in the first embodiment and in the prior art are compared.

Accordingly, the fluctuation of the surface temperature $\theta_H$ of each heat roller occurring when the photosensitive material 20 is brought into contact with the heat roller surface is controlled in such a way that hunting becomes small as compared with the conventional on-off control, as shown in FIG. 7A. For instance, in a case where, in the conventional on-off control, the set surface temperatures of the first and second heat rollers 84 and 86 are respectively 70° C. and 80° C. before the processing of the photosensitive material 20, and the deviations are respectively 2° C., the deviations can be controlled to within 1° C. by providing PID control, thereby making it possible to reduce the deviations from the set values by half.

Figure 7B:
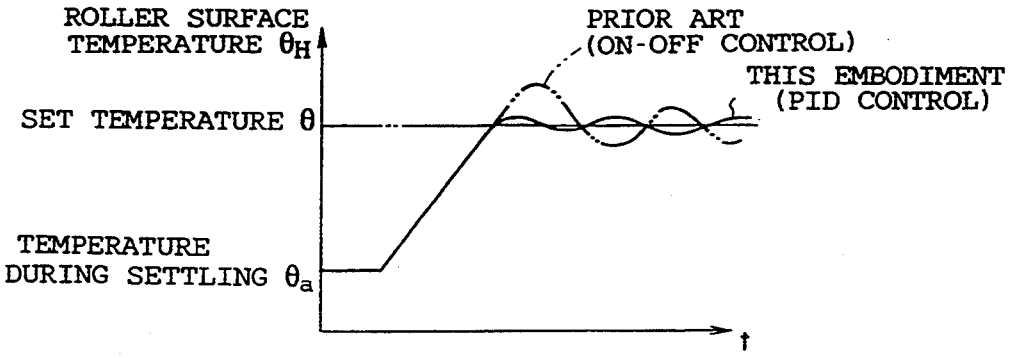

When the photosensitive material 20 is processed, in a case where, in the conventional on-off control, the set surface temperatures of the first and second heat rollers 84 and 86 are respectively 70° C. and 80° C., and the deviations are respectively 4° C., the deviations can be controlled to within 2° C. by providing PID control, thereby also making it possible to reduce the deviations by half. In addition, when the surface temperature of each heat roller is raised from the temperature (predetermined value $\theta_a$) for the standby period to the set value ($\theta_1$ or $\theta_2$), the fluctuation of the surface temperature $\theta_H$ of the heat roller can be made to converge to the set value within a short period of time, as shown in FIG. 7B.

In addition, in cases where the photosensitive material 20 to be dried is a standard type which dries at a standard drying speed, the thermal load is greater than in cases where the photosensitive material 20 which dries within a short time is dried, so that the speed of change of the surface temperature $\theta_H$ of the heat roller is fast. For this reason, in cases where the standard type photosensitive material 20 is dried, control is provided in such a manner that the response to the change of the surface temperature of the heat roller becomes quicker. However, if control similar to that of the case of drying the quick-drying type photosensitive material 20 is effected, the manipulated variable changes by an excessive degree with respect to the change of the surface temperature, so that the fluctuation of the surface temperature of the heat roller becomes large. For this reason, in this embodiment, an amount of change, L, per unit time of the roller surface temperature $\theta_H$ is calculated in Step 218 with respect to the samples $S_1$, $S_2$, $S_3$, and $S_4$ of the heat-roller surface temperature $\theta$ ($\theta_1$, $\theta_2\theta_3$, and $\theta_4$) in elapsed periods T ($T_1$, $T_2$, $T_3$, and $T_4$) through the following Formula (2):

$$\left.\begin{aligned} L &= \frac{\sum_{K=1}^{4} \{(T_k - \overline{T}) \times (\theta_k - \overline{\theta})\}}{4 \times \sigma_T^2} \\ \sigma_T^2 &= \frac{\sum_{i=1}^{4} (T_i - T)^2}{4} \end{aligned}\right\} \quad (2)$$

On the basis of this amount of change, L, a determination is made as to whether the photosensitive material 20 is the quick drying type or the standard type, and a determination is made as to whether or not the change of the paremeters of Formula (1) above is required. It should be noted that, in this embodiment, parameters suitable for the drying of the quick-drying type photosensitive material 20 are set as the standard values of the parameters. The aforementioned parameters are the proportional band (%) $P_b$, the integral time (sec) $T_1$, and the derivative time ( sec ) $T_d$.

If it is determined in Step 218 that it is necessary to change the parameters, appropriate parameters are selected in Step 224. For instance, as shown in FIG. 5A, in a case where the quick-drying type photosensitive material 20A, the standard type photosensitive material 20B, and the quick-drying type photosensitive material 20C are sequentially inserted, YES is given as the answer in the determination in Step 218 on the basis of the amount of change per unit time of the roller surface temperature $\theta_H$ due to the dry processing of the photosensitive material 20B, and parameters suitable for the drying of the standard type photosensitive material, for which emphasis is placed on the response characteristic, are selected in Step 224 (see FIG. 5E). Meanwhile, NO is given as the answer in the determination in Step 218 on the basis of the amount of change per unit time of the roller surface temperature $\theta_H$ due to the dry processing of the photosensitive material 20C, and parameters suitable for the drying of the quick-drying type photosensitive material are selected as the standard values of the parameters.

Figure 6B:
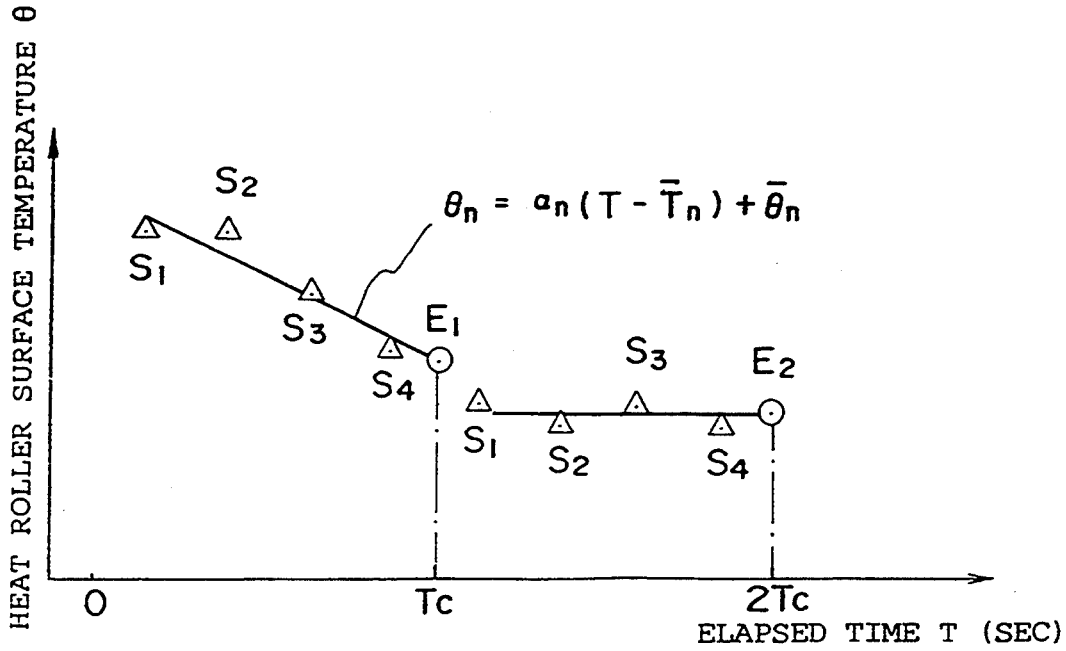
FIG. 6B is a graph illustrating the calculation for correction.

In an ensuing Step 226, instead of the calculation of a mean value in Step 220 above, a calculation for correction is made for each heat roller by placing emphasis on the response characteristic. For instance, in a case where the standard type photosensitive material, which exerts a large influence on the surface temperatures of the heat rollers, is dried by the heat rollers, as shown in FIG. 6B, the following Formula (3) is derived from Formula (2) above with respect to the samples $S_1$, $S_2$, $S_3$, and $S_4$ of the heat-roller surface temperature $\theta$ ($\theta_1$, $\theta_2$, $\theta_3$, and $\theta_4$) in the elapsed periods T ($T_1$, $T_2$, $T_3$, and $T_4$):

$$\theta = L \times (T - \overline{T}) + \overline{\theta} \quad (3)$$

On the basis of this Formula (3), the heat-roller surface temperature $\theta_5$ in an elapsed period $T_s$ during control is estimated, and the deviation $E_1$ from each of the set temperatures $\theta_1$ and $\theta_2$ is determined from that $\theta_5$. Thus, by determining the heat-roller surface temperature $\theta_5$ by using Formula (3) above, it is possible to reduce the influence of the noise attributable to the measurement of the heat-roller surface temperature on an ensuing control period.

In an ensuing Step 228, on the basis of the result $E_1$ of the calculation for correction using Formula (3), a calculation is made of the manipulated variable of each heat roller by using Formula (1) above. In an ensuing Step 230, the manipulated variables are converted to the power-supplying periods $t_1$ and $t_2$ and are outputted to the drivers 136 and 138. As for the manipulated variables, temperature control is effected through the changing of the parameters, the calculation for correction, and the like in correspondence with the types of photosensitive material 20 in such a manner that the fluctuations of the surface temperatures of the heat rollers become small.

In the above-described manner, in this embodiment, the photosensitive material 20 is first wound around the outer peripheral surface of the first heat roller 84 heated by the infrared heater 92 such that the emulsion surface is brought into contact therewith, and drying air is supplied to the photosensitive material 20 through the blow pipes 104 arranged along the outer periphery of the first heat roller 84 to dry the photosensitive material 20. Then, the photosensitive material 20 is wound around the outer peripheral surface of the second heat roller 86 heated by the infrared heater 94 such that the back surface is brought into contact therewith for drying. In addition, the surface temperature of the first heat roller 84 is set to approximately 70° C. at which the emulsion surface and the back surface of the photosensitive material 20 do not stick to the first heat roller 84 and the nip rollers 100, respectively. The surface temperature of the second heat roller 86 is set to approximately 80° C. which is higher than the surface temperature of the first heat roller 84 and which does not adversely affect the photosensitive material 20. This is because both surfaces of the photosensitive material 20 have already been dried to such a degree that the photosensitive material 20 does not stick to the second heat roller 86 at a temperature similar to that of the first heat roller 84. As a result, the photosensitive material 20 is dried speedily without sticking to the heat rollers 84 and 86 and the nip rollers 100.

In addition, since the overshooting of the fluctuation of the surface temperatures of the heat rollers 84 and 86 can be minimized through PID control, it is possible to speedily dry a plurality of photosensitive materials 20 without causing damage to their emulsion layers even if hard films are virtually not formed on the emulsion layers.

It should be noted that, as the processing information, it is possible to use information representing the types of the photosensitive material 20 (e.g., the quick-drying type and the standard type) which are inputted by the operation of the switch or the keyboard and stored in the RAM 128 in Step 212, in addition to the insertion timings of the photosensitive materials 20 based on the detected signals from the detector 28. In addition to the above, it is also possible to use as the processing information various kinds of other information necessary for drying the photosensitive material 20 in optimum conditions.

Although in this embodiment the photosensitive material 20 is inserted through the insertion port 26 of the photosensitive material processor 10 with its emulsion surface facing down, the photosensitive material 20 may be inserted therethrough with the emulsion surface facing upward insofar as the emulsion surface is first brought into contact with one heat roller and the back surface is then brought into contact with another heat roller.

Although in this embodiment the first and second heat rollers 84 and 86 are formed with identical sizes, i.e., identical radii, the radii may be made different. Since temperature control is conducted separately for the first and second heat rollers 84 and 86, it is possible to use heat rollers of different radii. Furthermore, although in this embodiment the first and second rollers are constituted by single heat rollers, respectively, each of the first and second rollers may be constituted by two or more heat rollers.

Although in this embodiment the surface temperatures of the heat rollers 84 and 86 are controlled by using the PID control, the surface temperatures of the heat rollers 84 and 86 may be controlled through control using membership functions by changing the membership functions themselves.

In addition, it is possible to conduct the on-off control whereby the criteria of turning on and off are changed for each sampling period by reducing the sampling period of the surface temperature (e.g., to 100 msec or less).

In this embodiment, the surface temperatures of the first and second heat rollers 84 and 86 may be determined in advance through experiments and the like such that the water content of the photosensitive material 20 discharged through the discharge port of the photosensitive material processor 10 becomes substantially equal to the water content of the photosensitive material 20 during exposure, and control may be effected in accordance with the results thus determined. This arrangement will make it possible to render substantially identical the sizes of the photosensitive material 20 during the exposure and after dry processing.

SECOND EMBODIMENT

Figure 8:
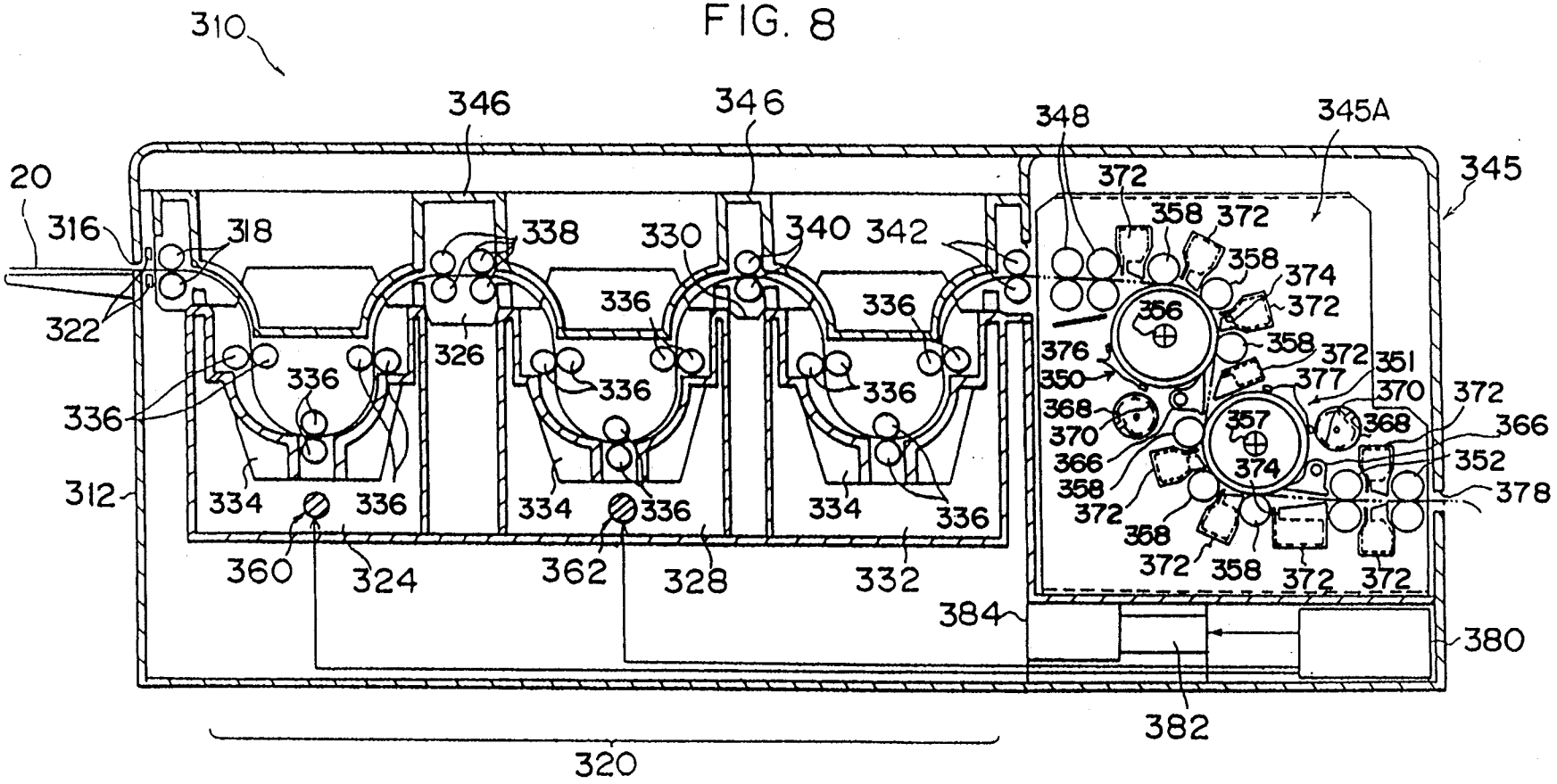
FIG. 8 is a side elevational view illustrating a schematic configuration of a photosensitive material processor in accordance with a second embodiment.

A description will be given hereafter of a second embodiment of the present invention. It should be noted that the same components as those of the first embodiment will be denoted by the same reference numerals, and a description thereof will be omitted. FIG. 8 schematically shows the structure of a photosensitive material processor 310 having a drier apparatus in accordance with the second embodiment.

The photosensitive material processor 310 has an insertion port 316 provided on the left-hand side surface (an upstream-side end) thereof as viewed in FIG. 8 for insertion of the photosensitive material 20. A pair of rollers 318 are disposed inwardly of the insertion port 316 and are rotated by an unillustrated driving means. Consequently, the photosensitive material 20 inserted into the photosensitive material processor 310 through the insertion port 316 is guided by the driving forces of the pair of rollers 318 into a processing station 320 disposed in the photosensitive material processor 310.

A detector 322 for detecting the photosensitive material 20 inserted into the interior is provided in the vicinity of the rollers 318. The detector 322 is arranged in the same way as the detector 28 of the first embodiment, and is turned on and off in correspondence with the width and length of the photosensitive material 20. The detector 322 is connected to the input/output ports 130 of the control circuit 122 (see FIG. 10). It should be noted that although a transmission-type detector 22 is used in this embodiment, it is possible to use a reflection-type detector which is adapted to detect light reflected from the photosensitive material.

A developing tank 324, a rinsing tank 326, a fixing tank 328, a rinsing tank 330, and a washing tank 332 are arranged in the processing station 320 in that order as viewed from the left-hand side of FIG. 8. A developing solution, a fixing solution, and washing water are stored in the developing tank 324, the fixing tank 328, and the washing tank 332 (which will be referred to the processing tanks when collectively called). In addition, a cleaning liquid (e.g. water or an aqueous solution of acetic acid) and a cleaning liquid (e.g. water) are supplied to the rinsing tank 326 and the rinsing tank 330, respectively, from respective unillustrated storage tanks through pipelines by means of pumps. Excess portions of the cleaning liquids are adapted to overflow from the rinsing tanks 326 and 330 to unillustrated overflow tanks. In a case where water is used as the cleaning liquids, an arrangement may be provided such that pipelines are provided directly from the water supply to the rinsing tanks 326 and 330 via solenoid valves without using the storage tanks, so as to supply tap water to the rinse tanks 326 and 330.

Racks 334 are disposed in the processing tanks 324, 328, and 332, respectively, and each rack 334 is provided with a plurality of pairs of rollers 336 for nipping and transporting the photosensitive material 20 along a predetermined transport passage. A crossover rack 346 having a rinse rack is disposed in each of the rinse tanks 326 and 330. Rollers 338 and 340 are provided in upper portions of the rinsing tanks 326 and 330, respectively, so as to nip and guide the photosensitive material 20 to an adjacent processing tank and to remove the processing solution adhering to the photosensitive material 20.

Heaters 360 and 362 are respectively disposed in the developing tank 324 and the fixing tank 328. These heaters 360 and 362 are each constituted by a cylinder made of a stainless steel alloy (e.g., SUS 316) and a coil-shaped heater body (not shown) serving as a heat source accommodated in the cylinder, and are inserted into the respective tanks by penetrating the side walls thereof. During a start-up, such as when the power supply of the photosensitive material processor 310 is turned on, the developing solution and the fixing solution are heated by the heaters 360 and 362 up to temperatures at which the photosensitive material 20 can be processed, and after the start-up the temperatures of these solutions are maintained at the levels which permit the processing of the photosensitive material 20. Meanwhile, a drier 345 in accordance with the present invention is disposed adjacent to the processing station 320. The photosensitive material 20 subjected to wash processing in the washing tank 332 is transported to the drier 345 by means of a pair of transport rollers 342.

Figure 9:
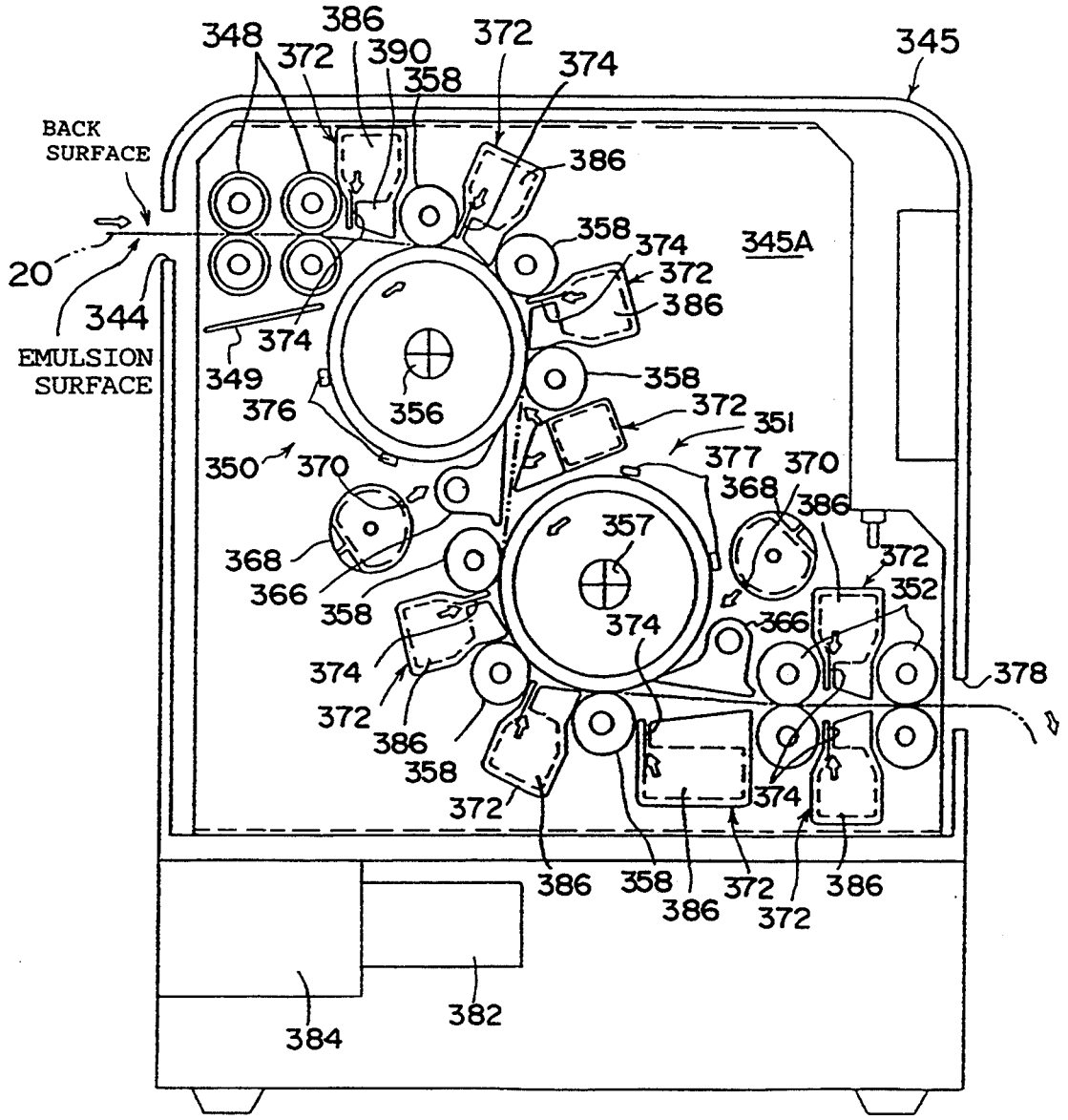
FIG. 9 is an enlarged view of a drier in accordance with the second embodiment.

As shown in FIGS. 8 and 9, the photosensitive material 20 is inserted into a drying chamber 345A of the drier 345 through a drying-chamber insertion port 344. In the same way as the interior of the drying chamber 78A of the first embodiment, two pairs of squeeze rollers 348, a first heat roller 350, a second heat roller 351, and two pairs of discharge rollers 352 are arranged in the drying chamber 345A along the transport passage of the photosensitive material 20, and these rollers are rotatably supported by an unillustrated pair of side plates. The squeeze roller pairs 348 are adapted to squeeze off water adhering to the photosensitive material 20 while nipping and transporting the photosensitive material 20. Furthermore, a guide 372 is disposed on the downstream side of the squeeze roller pairs 348 so as to guide the photosensitive material 20 onto the outer periphery of the heat roller 350 by means of ribs 390 provided on a leading-side edge, as viewed in the direction of travel of the photosensitive material 20, of the guide 372.

A drip plate 349 is disposed below the squeeze roller pairs 348, and the water squeezed off the photosensitive material 20 by the squeeze roller pairs 348 is thereby prevented from adhering to the surface of the first heat roller 350. The first and second heat rollers 350 and 351 are arranged substantially vertically inside the drying chamber 345A, and a transport passage of the photosensitive material is formed along the outer peripheral surface of each heat roller. A rod-like infrared heater 356 is concentrically disposed in an axial portion of the first heat roller 350, while a rod-like infrared heater 357 is concentrically disposed in an axial portion of the second heat roller 351.

Figure 10:
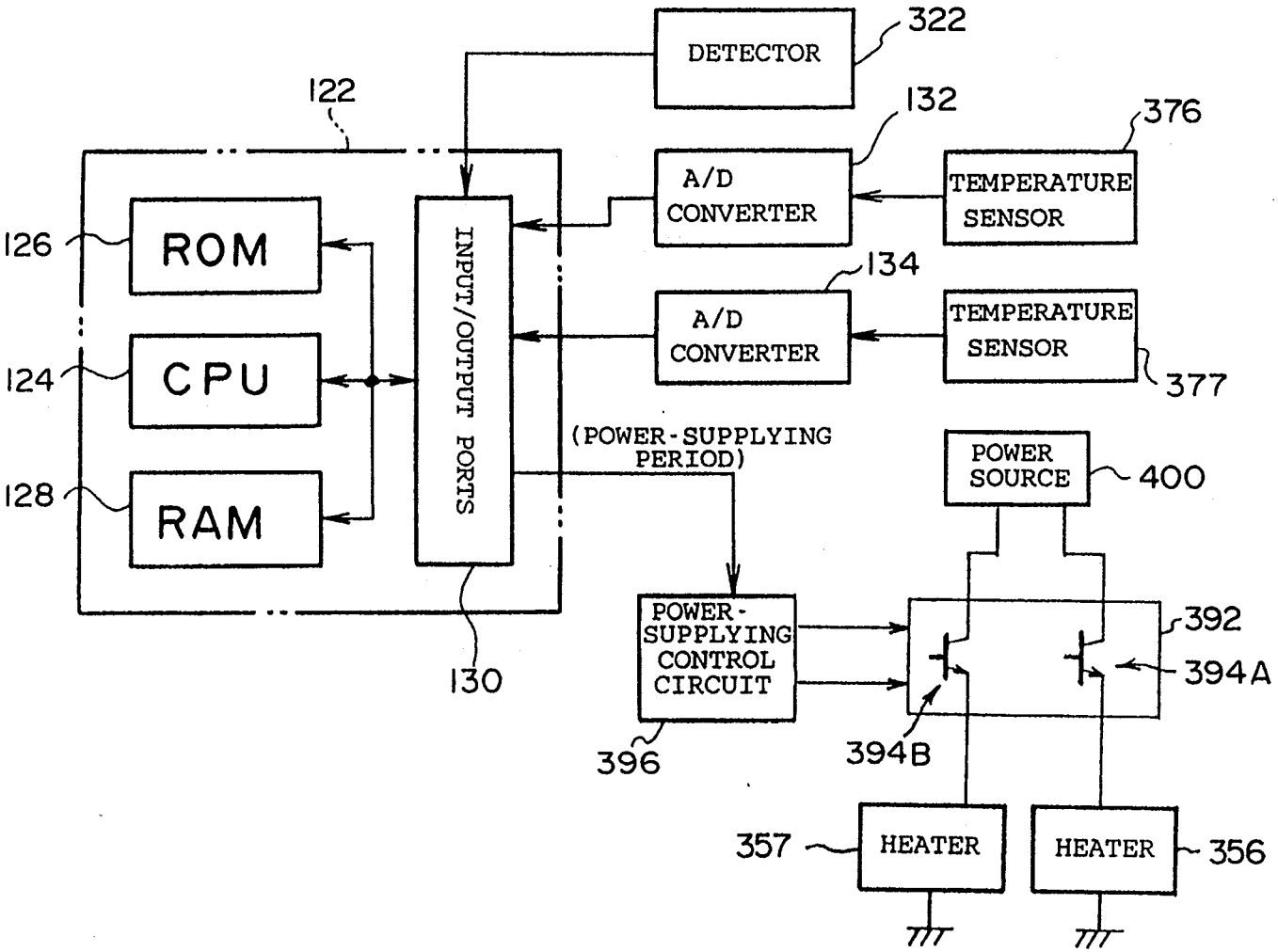
FIG. 10 is a schematic block diagram of a control circuit and its peripheral equipment in accordance with the second embodiment.

As shown in FIG. 10, the heater 356 is connected to the emitter of a transistor 394A serving as a switching element of a solid-state relay (SSR) circuit 392. The collector of the transistor 394A is connected to a constant-voltage power source 400 via a supply line. The SSR circuit 392 is connected to a power-supplying control circuit 396. While a signal indicating the supply of power to the heater 356 is being inputted from the power-supplying control circuit 396, this signal is supplied to the base of the transistor 394A. This causes the transistor 394A to be turned on, with the result that electric power is supplied from the power source 400 to the heater 356, thereby heating the first heat roller 350 by means of the radiant heat of the heater 356.

Also, the heater 357 is connected to the emitter of a transistor 394B of an SSR circuit 394, and the collector of the transistor 394B is connected to the power source 100 via a supply line. While a signal indicating the supply of power to the heater 357 is being inputted from the power-supplying control circuit 396, this signal is supplied to the base of the transistor 394B. This causes the transistor 394B to be turned on, with the result that electric power is supplied to the heater 357, thereby heating the second heat roller 351. The power-supplying control circuit 396 is connected to the input/output ports 130 of the control circuit 122. In the same way as the drivers 136 and 138 of the first embodiment, the power-supplying periods $t_1$ and $t_2$ for supplying power to the heaters 356 and 357 through the control circuit 122 are set in the power-supplying control circuit 396. Thus the Dower-supplying control circuit 396 outputs signals indicating the supplying of power to the heaters 356 and 357 for the set power-supplying periods mentioned above in such a manner that the periods of supplying power to the heaters will not overlap, as will be described later.

A plurality of nip rollers 358 are arranged around the first and second heat rollers 350 and 351 in such a manner as to abut against the outer peripheries of the heat rollers 350 and 351. The photosensitive material 20 wound around the heat rollers 350 and 351 is transported while being nipped by the heat rollers 350 and 351 and the nip rollers 358, and is heated by heat conduction as it is brought into contact with the outer peripheral surfaces of the heat rollers 350 and 351 heated by the heaters 356 and 357.

A release guide 366 is disposed on the downstream side, as viewed in the direction of travel of the photosensitive material 20, of each of the heat rollers 350 and 351. The release guide 366 has one end abutting against the outer peripheral surface of each heat roller and another end axially supported on an unillustrated pair of side plates, and is adapted to release the photosensitive material 20 wound around each of the heat rollers 350 and 351 from the outer peripheral surface of each of the heat rollers 350 and 351. In addition, an intermediate portion of the release guide 366 projects toward the downstream side in as viewed in the direction of travel of the photosensitive material 20 so as to guide the photosensitive material 20, which has been released from the outer peripheral surface of each of the heat rollers 350 and 351, toward the downstream side along the transport passage.

Additional guides 372 are respectively disposed between adjacent ones of the nip rollers 358 arranged around the heat rollers 350 and 351 and between the discharge roller pairs 352. The photosensitive material 20 transported by the squeeze roller pairs 348, the heat roller 350, the heat roller 351, and the discharge roller pairs 352 is guided by the guides 372 to the respective downstream sides. A guide body 386 of each guide 372 is a hollow cylinder of a substantially rectangular cross section having an opening formed at one longitudinal end thereof and having the other end closed, thereby constituting a chamber. Each guide 372 is arranged such that the longitudinal direction of the guide body 386 coincides with the widthwise direction of the photosensitive material 20 (in a direction perpendicular to the plane of FIG. 9), and is fixed to an unillustrated side plate. The guide body 386 of each guide 372 has, on its side facing the transport passage of the photosensitive material 20, a plurality of ribs 390 parallel with the direction of travel of the photosensitive material 20 as well as a slit 374 parallel with the longitudinal direction of the guide body 386 (the widthwise direction of the photosensitive material 20).

Blow pipes 368 are disposed on the sides of the heat rollers 350 and 351 which are away from the sides thereof where the photosensitive material 20 is wound. A slit 370 allowing the interior and the exterior of the blow pipe 368 to communicate with each other is formed in that surface of each blow pipe 368 which faces the transport passage of the photosensitive material in such a manner as to extend along the widthwise direction of the photosensitive material 20. A fan 382 and a heater 384 are disposed underneath the drying chamber 345A. Drying air produced by the fan 382 and the heater 384 is supplied to the blow pipes 358 and the guides 372 via unillustrated ducts. Accordingly, the drying air supplied to the blow pipes 368 and the guides 372 is discharged toward the surface of the photosensitive material 20 through the slits 370 and 374. High-humidity air which stagnates in the vicinity of the surfaces of the photosensitive material 20 heated by the heat rollers 350 and 351 is removed by means of this drying air. The photosensitive material 20 subjected to dry processing in the drying chamber 345A is discharged to outside the photosensitive material processor 310 through a discharge port 378.

A plurality of temperature sensors 376 are disposed in the vicinity of the outer periphery of the first heat roller 350, while a plurality of temperature sensors 377 are disposed in the vicinity of the outer periphery of the second heat roller 351 as well. The temperature sensors 376 are adapted to detect the surface temperature $\theta_{H1}$ of the outer peripheral surface of the first heat roller 350, while the temperature sensors 377 are adapted to detect the surface temperature $\theta_{H2}$ of the outer peripheral surface of the second heat roller 351. The temperature sensors 376 and 377 are connected to the input/output ports 130 of the control circuit 122 via the A/D converters 132 and 134, respectively.

Here, the set value $\theta_1$ of the surface temperature of the first heat roller 350 and the set value $\theta_2$ of the surface temperature of the second heat roller 351, which are stored in the ROM 126 of the control circuit 122, are set to substantially the same values ($\theta_1$=approx. 70° C., $\theta_2$=approx. 80° C.) as in the first embodiment. Accordingly, as has already explained in connection with the first embodiment, the photosensitive material 20 can be dried speedily without sticking to the first and second heat rollers 350 and 351. In addition, in the drier 345, a setting is provided such that drying at a constant rate of drying of the photosensitive material 20 is completed immediately after the photosensitive material 20 has passed by the position where the second heat roller 351 is located. For this reason, it is necessary to control the surface temperature of the downstream-side second heat roller 351 with greater accuracy than that of the upstream-side first heat roller 350. Accordingly, a first half section of the control period $T_c$ is allotted to the period of supplying power to the heater 357 for heating the second heat roller 351, as will be described later, so as to supply electric power preferentially to the heater 357.

A description will now be given of the operation of the second embodiment. When the photosensitive material 20 is inserted into the photosensitive material processor 310 through the insertion port 316, the insertion of the photosensitive material 20 is detected by the detector 322, and a detected signal is inputted to the control circuit 122. If the heat rollers 350 and 351 are not set to the predetermined surface temperatures, the control circuit 122 controls the power-supplying control circuit 396 by turning on the heaters 356 and 357 such that the predetermined surface temperatures will be reached when the photosensitive material 20 reaches these rollers.

The inserted photosensitive material 20 is drawn to the interior while being nipped by the transport rollers 318 and is guided by the guide surfaces of the crossover rack 346 so as to be transported into the developing tank 324. The photosensitive material 20 is then nipped by the rollers 336 disposed on the rack 334 inside the developing tank 324, is transported in a substantially U-shaped form in the developing solution, and is immersed in the developing solution stored in the developing tank 324. As a result, the photosensitive material 20 is subjected to development processing.

The photosensitive material 20 discharged from the developing tank 324 is cleaned by the cleaning liquid in the rinsing tank 326 while being nipped and transported by the rollers 338 in the rinsing tank 326, and is then guided by the guide surfaces of the crossover rack 346 and is fed to the fixing tank 328. In the fixing tank 328, the photosensitive material 20 is nipped by the rollers 336 disposed on the rack 334 and is transported in a substantially U-shaped form in the fixing solution, thereby undergoing fixation processing by being immersed in the fixing solution in the fixing tank 328. The photosensitive material 20 discharged from the fixing tank 328 is, while being nipped and transported by the rollers 340, subjected to cleaning with the cleaning liquid in the rinsing tank 330, and is then fed to the washing tank 332 while being guided by the guide surfaces of the crossover rack 346.

In the washing tank 332, the photosensitive material 20 is nipped by the rollers 336 and is transported through the cleaning liquid, thereby undergoing wash processing. The developing solution and the fixing solution stored in the developing tank 324 and the fixing tank 328 are heated up to predetermined temperatures which permit the processing of the photosensitive material 20, and these temperatures are maintained. The photosensitive material 20 subjected to wash processing in the washing tank 332 is inserted into the drying chamber 345A of the drier 345 with the emulsion surface facing downward, as shown in FIG. 9.

The photosensitive material 20 inserted into the drying chamber 345A is squeezed by the squeeze roller pairs 348, is then guided by the ribs 390 of the guide 372, and is wound around the first heat roller 350 in such a manner that the emulsion surface is brought into contact with the outer peripheral surface of the first heat roller 350. The first heat roller 350 is heated by the heater 356, and its surface temperature is controlled such that it is set to a temperature (e.g., approx. 70° C.) which is lower than the surface temperature of the second heat roller 351 and at which the emulsion surface and the back surface of the photosensitive material 20 do not stick to the first heat roller 350 and the nip rollers 358.

For this reason, the photosensitive material 20 is heated and dried without its emulsion surface sticking to the first heat roller 350. In the state in which the photosensitive material 20 is wound around the first heat roller 350, the back surface of the photosensitive material 20 is heated as the heat supplied from the first heat roller 350 is conducted thereto. Part of the drying air produced by the fan 382 and the heater 384 is blown onto the photosensitive material 20 through the guides 372 and the blow pipes 368, thereby drying the photosensitive material 20 to some extent.

The photosensitive material 20, which has been dried to some extent by passing by the first heat roller 350, is wound around the second heat roller 351 in such a manner that the back surface is brought into contact with the outer peripheral surface of the second heat roller 351. The second heat roller 351 is heated by the heater 357, and is controlled such that the surface temperature is set to a temperature (e.g., approx. 80° C.) higher than that of the first heat roller 350.

As described before, since the back surface is already dry to some extent after it has passed by the first heat roller 350, even if the surface temperature of the second heat roller 351 is set to be higher than that of the first heat roller 350, the photosensitive material 20 does not stick to the second heat roller 351. The emulsion surface of the photosensitive material 20 is preheated by the first heat roller 350, and is further heated as the heat supplied by the second heat roller 351 is conducted thereto, and is dried as the drying air discharged through the guides 372 and the blow pipes 368 is blown onto it.

Thus, as the emulsion surface and the back surface of the photosensitive material 20 are wound around the first and second heat rollers 350 and 351, respectively, both the emulsion surface and the back surface can be dried uniformly, so that it is possible to prevent the occurrence of a curl and the like due to the nonuniform drying of the obverse and reverse surfaces. The photosensitive material 20 dried by the drier 345 is nipped and transported by the discharge roller pairs 352 while being guided by the guide 372, and is discharged to outside the photosensitive material processor 310 through the discharge port 378.

Referring now to the flowchart shown in FIG. 11, a description will be given of the processing of power-supplying control by the power-supplying control circuit 396. In Step 150, the power-supplying period $t_1$ for the heater 356 and the power-supplying period $t_2$ for the heater 357 are fetched. These power-supplying periods $t_1$ and $t_2$ are determined by the processing of power-supplying period setting by the control circuit 122 described with reference to the flowcharts shown in FIGS. 4A and 4B in the first embodiment, and is set in a memory and the like of the power-supplying control circuit 396.

Figure 12A:
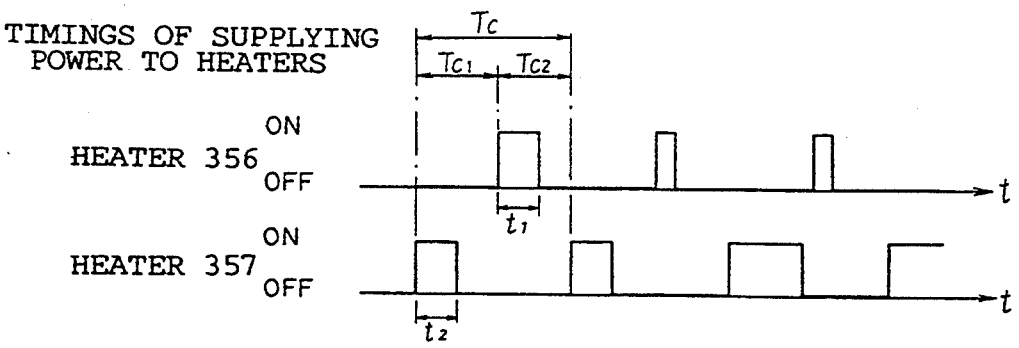
FIG. 12A is a timing chart illustrating power-supplying timings in a case where the lengths of sections allotted to heaters are changed.

In Step 152, a determination is made as to whether or not a power-supplying start timing for the heater 357 has arrived. In this embodiment, one cycle of control is completed in a fixed control period $T_c$, and this control period $T_c$ is divided into two sections $T_{c1}$ and $T_{c2}$ in correspondence with the number of the heaters (two in this embodiment), as shown in FIG. 12A. The first half section $T_{c1}$ of the control circuit $T_c$ is made to correspond to the heater 357, while the second half section $T_{c2}$ is made to correspond to the heater 356. The supplying of power to the heater 357 is effected within the section $T_{c1}$, while the supplying of power to the heater 356 is effected within the section $T_{c2}$. The determination in the aforementioned Step 152 is made as to whether or not the timing at which the section $T_{c1}$ starts has arrived. It should be noted that the lengths of the power-supplying periods $t_1$ and $t_2$ are set to be less than the sections $T_{c1}$ and $T_{c2}$, respectively.

The determination in Step 152 is repeated until YES is given as the answer, and if YES is given as the answer in the determination in Step 152, the signal indicating the supplying of power to the heater 357 is generated in Step 154, thereby turning on the transistor 394B of the SSR circuit. As a result, electric power is supplied from the power source 40 to the heater 357 via the supply line and the transistor 394B to cause the heater 357 to generate heat, thereby heating the second heat roller 351. In an ensuing Step 156, a determination is made as to whether or not the power-supplying period $t_2$ for the heater 357 has elapsed. If NO is given as the answer in the determination in Step 156, the operation returns to Step 154 to continue the supplying of power to the heater 357 until YES is given as the answer in the determination in Step 156.

If YES is given as the answer in the determination in Step 156, the operation proceeds to Step 158, and by determining whether or not a timing at which the aforementioned section $T_{c2}$ starts has arrived, a determination is made as to whether or not the timing for starting the power supply to the heater 356 has set in. The determination in Step 158 is also repeated until YES is given as the answer, and if YES is given as the answer in Step 158, the signal indicating the supplying of power to the heater 356 is generated in Step 160, thereby turning on the transistor 394A. As a result, electric power is supplied from the power source 400 to the heater 356 via the supply line and the transistor 394A to cause the heater 356 to generate heat, thereby heating the first heat roller 350.

In Step 162, a determination is made as to whether or not the power-supplying period $t_1$ for the heater 356 has elapsed. If NO is given as the answer in the determination in Step 162, the operation returns to Step 160 to continue the supplying of power to the heater 356 until YES is given as the answer in the determination in Step 162. If YES is given as the answer in the determination in Step 162, the operation returns to Step 152 to repeat the above-described processing.

Figure 12B:
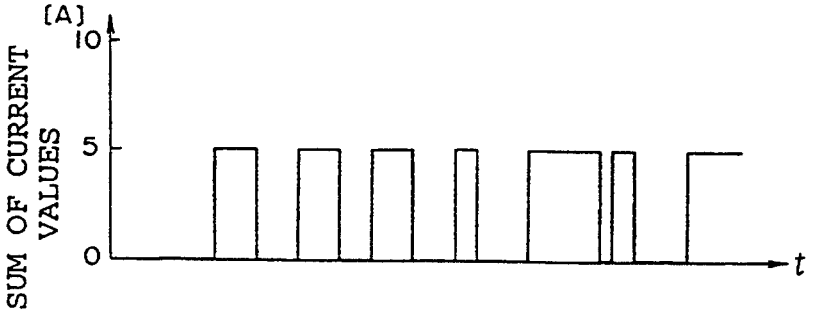
FIG. 12B is a timing chart illustrating the change of the sum of values of currents flowing across the heaters.
Figure 13A:
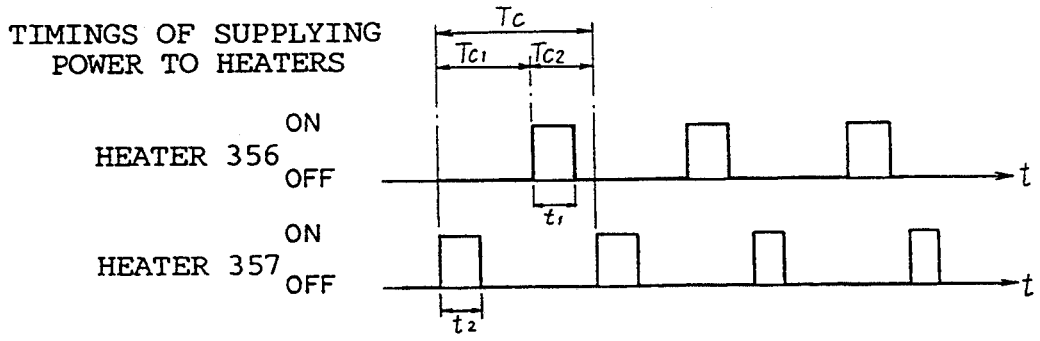
FIG. 13A is a timing chart illustrating power-supplying timings in a case where the lengths of sections allotted to the heaters are changed.
Figure 13B:
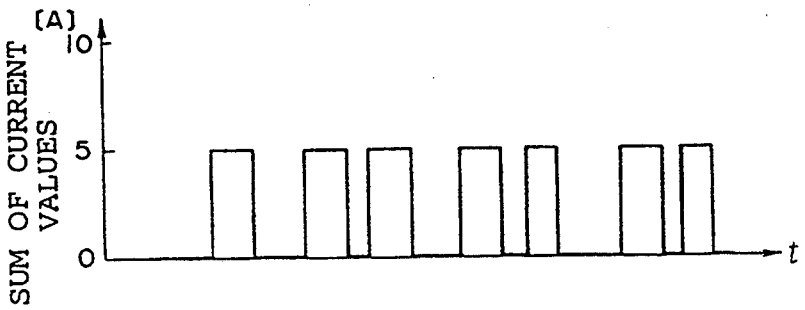
FIG. 13B is a timing chart illustrating the change of the sum of values of currents flowing across the heaters.

Through the above-described processing, since the suppling of power to the heater 35V is effected within the section $T_{c1}$ and the supplying of power to the heater 356 is effected within the section $T_{c2}$, as shown in FIG. 12A, cases where power is supplied simultaneously to the heaters 356 and 35V are nil. Hence, the peak value of the sum of electric currents flowing across the heaters can be controlled to a low level, as shown in FIG. 12B. Accordingly, in the power-supplying means constituted by the power source 400, the SSR circuit 392, and the supply lines, and so on, it is possible to reduce the capacity of the power source 400 and to use supply lines and switching elements with a small allowable current. Hence, the cost of the power-supplying means can be reduced.

In normal cases, the power-supplying periods $t_1$ and $t_2$ do not become longer than the lengths of the sections. However, immediately after the photosensitive material 20 has been brought into contact with one heat roller, there are cases where the surface temperature of the heat roller declines substantially, and the power-supplying period $t_1$ obtained becomes longer than the section $T_{c2}$. In such a case, an arrangement may be provided such that a period equal to or slightly shorter than the section $T_{c2}$ is set as the power-supplying period $t_1$, the difference between the power-supplying period determined and an actually set power-supplying period is stored in advance, and this difference is added to the power-supplying period $t_1$ determined in an ensuing control period. Alternatively, the proportion of the sections $T_{c1}$ and $T_{c2}$ of the control period may be temporarily altered. This also applies to cases where the power-supplying period $t_2$ has become longer than the length of the section $T_{c1}$. In addition, since the surface temperature of the second heat roller 351 needs to be controlled with greater accuracy than that of the first heat roller 350, in the event that the power-supplying period $t_2$ has become longer than the section $T_{c1}$, and the power-supplying period $t_1$ has become longer than the section $T_{c2}$, the supplying of power to the heater 357 is carried out preferentially.

Although, in the above description, the control period $T_c$ is divided in such a manner that the lengths of the sections $T_{c1}$ and $T_{c2}$ become equal, the lengths of the divided sections need not be made equal. For instance, in this embodiment, since the set value $\theta_2$ for the heat roller 351 is higher than the set value $\theta_1$ for the heat roller 350, the total value of the power-supplying periods becomes greater for the heater 357 than for the heater 356. For this reason, if the length of the section $T_{c1}$ for supplying power to the heater 357 is made longer than the length of the section $T_{c2}$ in advance, it is possible to smoothly effect temperature control without needing to provide the above-described exceptional processing.

Figure 11:
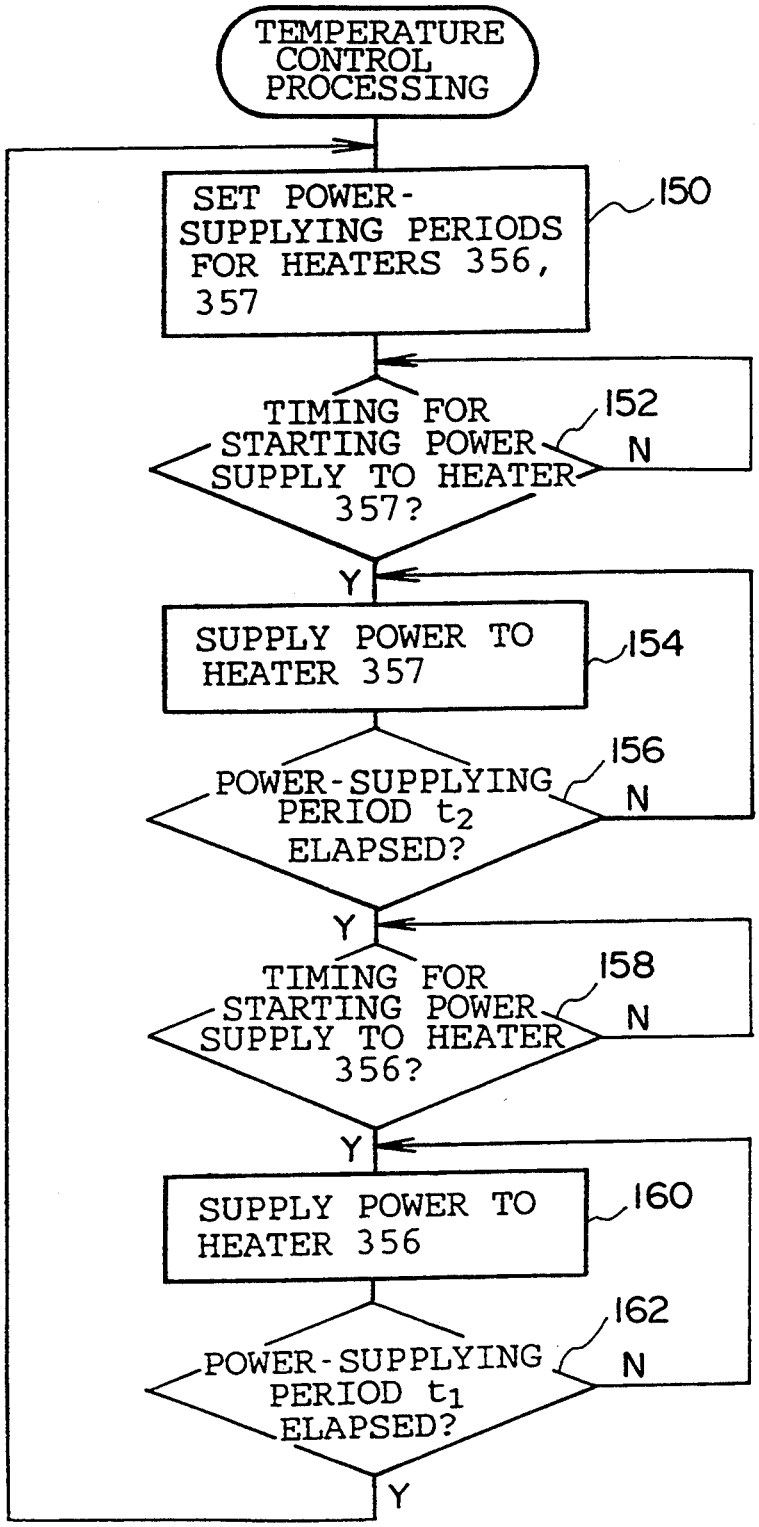
FIG. 11 is a flowchart illustrating temperature control processing by means of a power-supplying control circuit.
Figure 14:
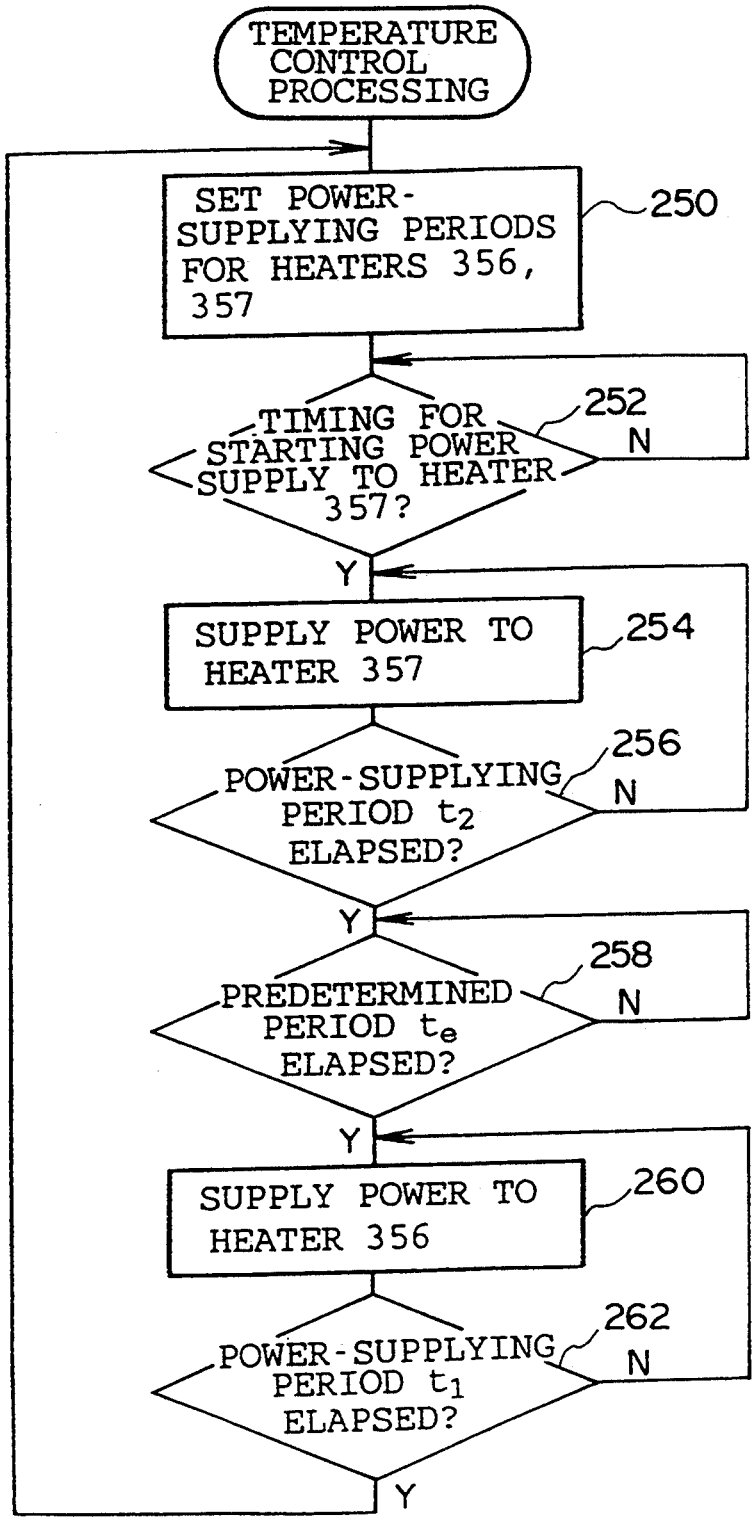
FIG. 14 is a flowchart illustrating another example of temperature control processing.

In addition, the processing of temperature control by the power-supplying control circuit 396 is not restricted to the processing shown in the flowchart in FIG. 11. For example, in the temperature control processing shown in the flowchart in FIG. 14, after the lapse of the power-supplying period $t_2$ and YES is given as the answer in a determination in Step 256 followed by stopping the supplying of power to the heater 357, a determination is made in Step 258 as to whether or not a predetermined time $t_e$ has elapsed. This predetermined time $t_e$ is set to be equal to or slightly longer than a time lag from the time the transistor 94 is turned off until the current value converges to 0. If YES is given as the answer in the determination in Step 256, the supplying of power to the heater 356 is started in an ensuing Step 260.

Figure 15A:
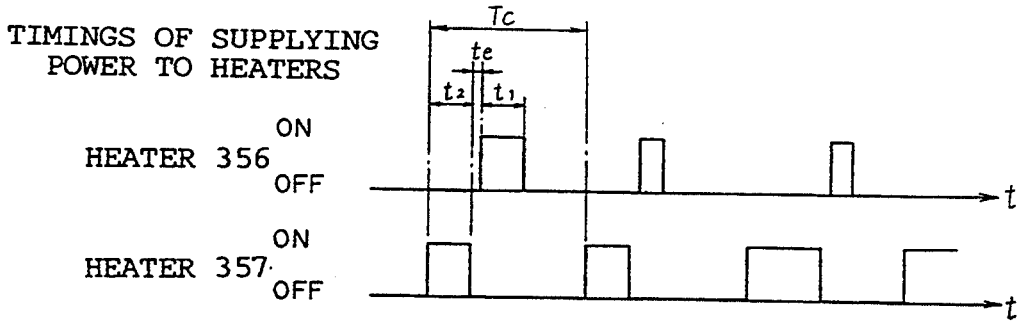
FIG. 15A is a timing chart illustrating timings of supplying power to the heaters in the temperature control processing shown in FIG. 13A.
Figure 15B:
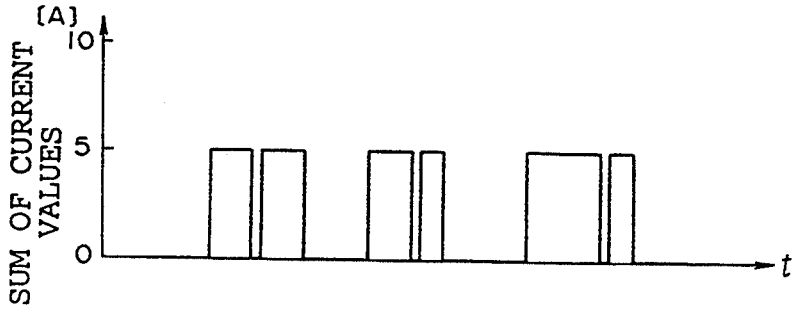
FIG. 15B is a timing chart illustrating the change of the sum of values of currents flowing across the heaters.
Figure 16A:
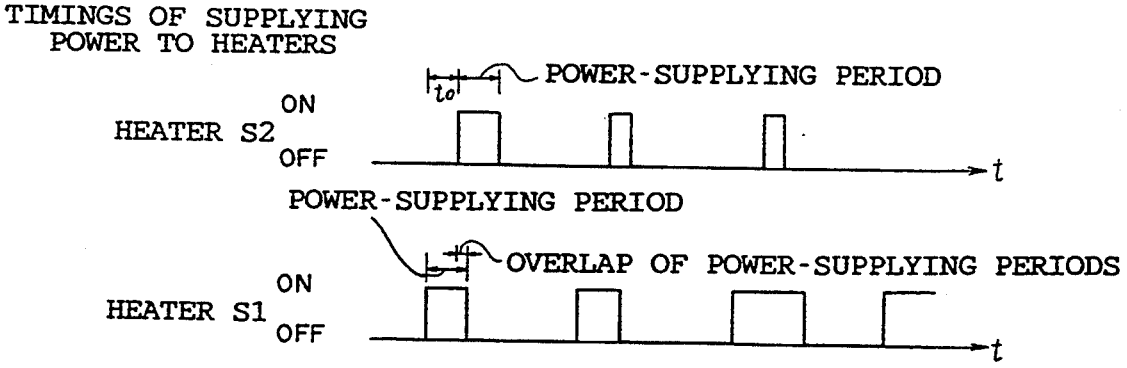
FIG. 16A is a timing chart illustrating timings of supplying power to the heaters in prior art drier apparatus.
Figure 16B:
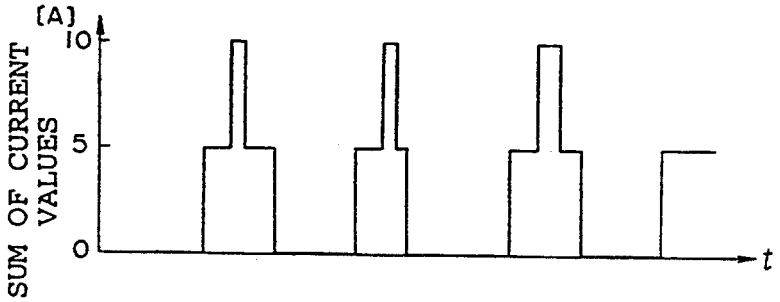
FIG. 16B is a timing chart illustrating the change of the sum of values of currents flowing across the heaters in accordance with the prior art.

Consequently, as shown in FIG. 15A, the leading end of the control period $T_c$ is set to be a timing for supplying power to the heater 357, and a period after the lapse of that power-supplying period is allotted to the power-supplying period for the heater 356. In this temperature control processing as well, as shown in FIG. 15B, the power-supplying period for the heater 356 and the power-supplying period for the heater 357 do not overlap, so that the peak value of the sum of the currents flowing across the heaters 356 and 357 can be controlled to a low level. Accordingly, it is possible to reduce the capacity of the power source 100 and use supply lines and switching elements with a small allowable current as compared with the prior art, so that the cost of the power-supplying means can be reduced.

Furthermore, although, in the above description, the power-supplying periods $t_1$ and $t_2$ for the heaters 356 and 357 per control period $T_c$ are calculated by PID control to effect temperature control processing, as described in connection with the first embodiment, the present invention is not restricted to the same. For instance, an arrangement may be alternatively provided such that the temperature control processing is effected by the so-called on-off control in which power is supplied to the heater 357 until the surface temperature of the heat roller 351 reaches the set temperature $\theta_1$ plus a predetermined temperature $\alpha$, and power is then supplied to the heater 356 until the surface temperature of the heat roller 350 reaches the set temperature $\theta_1$ plus the predetermined temperature $\alpha$ after the lapse of the predetermined time $t_e$, and this process is repeated subsequently.

What is claimed is:

1. A drier apparatus for drying sheets of photosensitive material processed with processing solutions while the photosensitive material is being transported, comprising:

a roller driven to rotate for transporting the photosensitive material along a transport passage and for drying the photosensitive material by heating the photosensitive material;

heating means for heating the surface of said roller;

temperature detecting means for detecting a surface temperature of said roller; and control means for controlling said heating means such that a range of fluctuation of the surface temperature of said roller falls within a predetermined range of values by selecting an appropriate characteristic for drying the photosensitive material, on the basis of a change with time of the surface temperature of said roller detected by said temperature detecting means.

2. The drier apparatus according to claim 1, wherein said control means controls said heating means by PID control in such a manner that the range of fluctuation of the surface temperature of said roller falls within the predetermined range of values.

3. The drier apparatus according to claim 2, wherein said control means sets a period of supplying power to said heating means on the basis of the surface temperature of said roller detected by said temperature detecting means.

4. The drier apparatus according to claim 2, wherein said control means controls said heating means such that the surface temperature of said roller falls within the predetermined range of values before a leading end of the photosensitive material reaches said roller.

5. A drier apparatus for drying sheets of photosensitive material processed with processing solutions while the photosensitive material is being transported, comprising:

roller means disposed in a transport passage for transporting the photosensitive material and for drying the photosensitive material by heating the photosensitive material;

heating means for heating said roller means;

temperature detecting means for detecting a surface temperature of said roller means; and control means for controlling said heating means such that a range of fluctuation of the surface temperature of said roller means falls within a predetermined range of values, on the basis of a change with time of the surface temperature of said roller means detected by said temperature detecting means and by selecting an appropriate characteristic from characteristics stored in the control means on the basis of processing information on the photosensitive material.

6. The drier apparatus according to claim 5, wherein said control means controls said heating means by PID control in such a manner that the range of fluctuation of the surface temperature of said roller means falls within the predetermined range of values.

7. The drier apparatus according to claim 6, wherein said control means sets a period of supplying power to said heating means on the basis of the surface temperature of said roller means detected by said temperature detecting means.

8. The drier apparatus according to claim 6, wherein said control means controls said heating means such that the surface temperature of said roller means falls within the predetermined range of values before a leading end of the photosensitive material reaches said roller means.

9. The drier apparatus according to claim 5, wherein, in a case where a plurality of photosensitive materials are successively inserted into said drier apparatus, said processing information on the photosensitive material relates to insertion timings at which the plurality of photosensitive materials are inserted or types of the photosensitive materials inserted into said drier apparatus.

10. The drier apparatus according to claim 9, wherein, if the insertion timing is at a predetermined value or longer, said control means sets the period of supplying power to said heating means so as to lower the surface temperature of said roller means.

11. The drier apparatus according to claim 9, wherein, in a case where the type of the photosensitive material is a quick-drying type, said control means sets the period of supplying power to said heating means on the basis of a mean value of the surface temperature of said roller means which changes with time.

12. The drier apparatus according to claim 11, wherein, in a case where the type of the photosensitive material is a type other than the quick-drying type, said control means sets the period of supplying power to said heating means by estimating the surface temperature of said roller means persisting after a lapse of a predetermined time, on the basis of the surface temperature of said roller means changing with time and detected by said temperature detecting means.

13. A drier apparatus for drying sheets of photosensitive material processed with processing solutions while the photosensitive material is being transported, comprising:

a plurality of rollers disposed along a transport passage for transporting the photosensitive material and for drying the photosensitive material by heating the photosensitive material;

a plurality of heaters disposed in correspondence with said plurality of rollers and adapted to heat the surface of said rollers as electric power is supplied to said plurality of heaters;

temperature detecting means for detecting the surface temperature of each of said plurality of rollers;

power supplying means for supplying power to each of said plurality of heaters; and control means for operating said power supplying means for each predetermined period on the basis of the surface temperature of each of said plurality of rollers detected by said temperature detecting means and for controlling said power supplying means such that periods of supplying power to said plurality of heaters do not overlap.

14. The drier apparatus according to claim 13, wherein said control means controls said power supplying means by dividing a power-suppliable period of each of said plurality of heaters for said each predetermined period such that the periods of supplying power to said plurality of heaters do not overlap.

15. The drier apparatus according to claim 13, wherein said control means sets in advance the order of priority of the power-supplying periods for said plurality of heaters, and controls said power supplying means in such a manner as to supply power sequentially beginning with a heater of a highest order and then heaters of lesser orders among said plurality of heaters for said each predetermined period.

16. The drier apparatus according to claim 13, wherein said control means sets the power-supplying period for each of said plurality of heaters corresponding to said plurality of rollers on the basis of the surface temperature of each of said plurality of rollers detected by said temperature detecting means.

17. The drier apparatus according to claim 14, wherein said control means sets the power-supplying period for supplying power to said power supplying means to be shorter than the power-suppliable period.

18. The drier apparatus according to claim 17, wherein said control means controls said power supplying means in such a manner that the supplying of power to each of said plurality of heaters is effected when a corresponding power-suppliable period sets in.

19. The drier apparatus according to claim 13, wherein said control means sets a non-supplying period between adjacent ones of the power-supplying periods for said plurality of heaters.

20. A drier apparatus for drying sheets of photosensitive material processed with processing solutions while the photosensitive material is being transported, comprising:

roller means disposed in a transport passage for transporting the photosensitive material and for drying the photosensitive material by heating the photosensitive material, wherein said roller means has at least two rollers, the photosensitive material being wound around said at least two rollers alternatively so that a front surface of the photosensitive material contacts one of said at least two rollers, and so that a rear surface of the photosensitive material contacts an other of said at least two rollers, and the photosensitive material is transported by said at least two rollers;

heating means for heating said roller means;

temperature detecting means for detecting a surface temperature of said roller means;

blowing means disposed for supplying drying air to a surface which is opposite to a surface contacting a roller of said at least two rollers around which the photosensitive material is wound; and control means for controlling said heating means such that a range of fluctuation of the surface temperature of said roller means falls within a predetermined range of values by selecting an appropriate characteristic for drying the photosensitive material, on the basis of a change with time of the surface temperature of said roller means detected by said temperature detecting means.

* * * * *